US011814769B2

(12) United States Patent
Cocks

(10) Patent No.: US 11,814,769 B2
(45) Date of Patent: Nov. 14, 2023

(54) IRONING BOARD

(71) Applicant: R&D CONCEPTS LIMITED, Reigate Surrey (GB)

(72) Inventor: David Cocks, London (GB)

(73) Assignee: R&D CONCEPTS LIMITED, Reigate (GB)

( * ) Notice: Subject to any disclaimer, the term of this patent is extended or adjusted under 35 U.S.C. 154(b) by 0 days.

(21) Appl. No.: 17/622,595

(22) PCT Filed: Jun. 26, 2020

(86) PCT No.: PCT/GB2020/051553
§ 371 (c)(1),
(2) Date: Dec. 23, 2021

(87) PCT Pub. No.: WO2020/260893
PCT Pub. Date: Dec. 30, 2020

(65) Prior Publication Data

US 2022/0356639 A1 Nov. 10, 2022

(30) Foreign Application Priority Data

Jun. 27, 2019 (GB) ..... 1909226
Feb. 20, 2020 (GB) ..... 2002401

(51) Int. Cl.
*D06F 81/04* (2006.01)

(52) U.S. Cl.
CPC ..... *D06F 81/04* (2013.01)

(58) Field of Classification Search
CPC ..... D06F 81/00; D06F 81/04; D06F 81/08
See application file for complete search history.

(56) References Cited

U.S. PATENT DOCUMENTS 858,969 A * 7/1907 French ..... A47B 3/087 38/139
1,209,150 A * 12/1916 Hannold ..... A47B 3/04 38/139
1,532,973 A * 4/1925 Adelson ..... D06F 81/06 108/116
1,937,886 A * 12/1933 Grose ..... A47C 12/02 38/112

(Continued)

FOREIGN PATENT DOCUMENTS

CN 204435025 7/2015
EP 1602777 A2 * 12/2005 ..... D06F 81/02

(Continued)

OTHER PUBLICATIONS

GB Examination Report for GB Application No. 2002401.4 dated Oct. 12, 2022.

(Continued)

*Primary Examiner* — Ismael Izaguirre
(74) *Attorney, Agent, or Firm* — DeWitt LLP

(57) ABSTRACT

An ironing board having a board, an upwardly extending support that is self-supporting, and a pivot that pivotally connects the board and the upwardly extending support. The pivot being arranged so that the board is rotatable about the pivot and relative to the upwardly extending support between a stowed orientation and an ironing orientation. The pivot is fixed relative to both the board and the upwardly extending support.

17 Claims, 20 Drawing Sheets

(56) References Cited

U.S. PATENT DOCUMENTS

| | | | | | |
|---|---|---|---|---|---|
| 2,439,769 | A | | 4/1948 | Booth | |
| 2,647,333 | A | * | 8/1953 | Olshefski | D06F 81/02 38/139 |
| 2,994,145 | A | * | 8/1961 | Dall | A47B 77/10 108/81 |
| 3,148,639 | A | * | 9/1964 | Otilio | D06F 81/04 108/169 |
| 4,536,978 | A | * | 8/1985 | Cerutti | D06F 81/08 38/103 |
| 6,643,960 | B2 | * | 11/2003 | Manfiotto | D06F 81/04 38/DIG. 3 |

FOREIGN PATENT DOCUMENTS

| | | |
|---|---|---|
| EP | 2169108 | 3/2010 |
| GB | 2397072 | 7/2004 |
| WO | WO2007004135 | 1/2007 |
| WO | WO2007057419 | 5/2007 |
| WO | WO2016078912 | 5/2016 |

OTHER PUBLICATIONS

GB Search Report for GB Application No. 2002401.4 dated Dec. 8, 2020.

International Search Report and Written Opinion for PCT/GB2020/051553 dated Sep. 15, 2020.

* cited by examiner

IRONING BOARD

The present invention relates to an improved ironing board on which clothing, linens or similar articles are ironed or pressed using a heated tool such as an iron.

BACKGROUND OF THE INVENTION

Ironing boards providing a flat, horizontal board to provide a heat-resistive surface on which articles can be ironed are widely known. For domestic applications, ironing boards are typically portable, having a board attached to a collapsible support that allows the ironing board to be stowed compactly in a cupboard or other space.

A traditional ironing board design includes a board having a top face. The top face is suitably covered with a cover that comes into contact with the articles to be ironed. A padding layer may be provided between the top face of the board and the cover. Often, the board is constructed from a perforated metal sheet, wherein the perforations help cool the top face or attached coverings. It is common for the board to be shaped to be broad at one end and tapered at the other forming a nose. Also, it is known to use various attachments on the board, such as: a pole for holding the cord of the iron out of the way, a bar for hanging garments after they are pressed, or a sleeve board providing a smaller surface specifically for ironing shirt sleeves. Most ironing boards also include a dock for laying the iron down safely when not in use. Generally, the dock is provided as an extension to one end of the board, for instance the broad end.

The collapsible support for a traditional ironing board design typically comprises a pair of legs. Each leg has a foot to provide lateral stability. Often the legs are formed from metal tubes and the design can be referred to as a T-Leg design. One of the legs is pivotally attached to the board towards one end at a fixed pivot. The other leg is attached to the board via a sliding pivot. Here, the leg is attached to pivot relative to the board as well as to slide longitudinally along the board towards and away from the fixed pivot of the other leg. A lock is provided to lock and unlock the sliding pivot relative to the board. The two legs are pivotally connected to each other at a fixed pivot spaced from the pivot connections to the board and ends of the legs. Thus the pair of legs forms an 'X' shape when open and the board moves parallel to a plane between the feet. The respective pivots between the legs and board form a linkage.

In operation, from a stowed orientation wherein the collapsible support is collapsed against the board, the sliding pivot is released and the sliding pivot slides towards the fixed pivot of the other leg. Constrained by the linkage, the legs open to support the board horizontally in an ironing orientation. By locking the sliding pivot relative to the board, the linkage forms a rigid structure. The board can be raised or lowered by unlocking the sliding pivot and adjusting the location of the sliding pivot towards or away from the fixed pivot respectively. The ironing board can be collapsed back to the stowed orientation, by unlocking the sliding pivot and moving the sliding pivot away from the board's fixed pivot so that the legs lie against the board and in a generally common plane.

Opening and collapsing an ironing board having a board supported by a collapsible support in a T-leg design requires the sliding pivot to be unlocked whilst supporting the board or manipulating the legs. It therefore typically requires two hands. In order to reduce the cumbersome nature of the opening and collapsing, EP2169108 discloses an ironing board including a vertical support structure, board and collapsible support. The board is connected to the vertical support structure at a broad end by a sliding pivot. The foldable support comprises a main leg that is connected at one end to a lower end of the vertical support by a fixed pivot and connected to the board via a sliding pivot at the other end. The collapsible support includes a second leg assembly and the main leg and second leg assembly form an 'X' shape in an open arrangement. The second leg assembly includes a minor leg that is pivotally attached to a mid-point of the main leg. The second leg assembly also includes an articulated arm that is pivotally connected to the board near the connection between the board and vertical support and pivotally connected to the minor leg at a location spaced from the connection between the minor leg and main leg.

In a stowed orientation, the board's top face is arranged to face the vertical support structure with the sliding pivot between the board and vertical support structure arranged towards the lower end. The board is arranged in a generally vertical orientation with a nose end of the board uppermost. Here the collapsible support is arranged on an outside of the ironing board and may therefore require restraining.

The ironing board can be manipulated to the ironing orientation by holding the nose of the board and rotating the board towards a horizontal orientation. The constraints of the linkage formed by the main leg, minor leg and articulated arm cause the collapsible support to open. Due to the linkage arrangement, when the minor leg reaches its maximum angle relative to the major leg, manipulation of the ironing board changes to raising the broad end of the board to slide the pivot connection between the board and vertical support structure further upwards. Thus a user would tend to change grip location. In particular, the user would tend to grip the broad end that would be located towards the lower end of the vertical support. A mechanical lock is provided to secure the sliding pivot between the board and vertical support structure and so as to lock the ironing board in the ironing orientation. Releasing the mechanical lock followed by the reverse manipulation collapses the ironing board back to the stowed orientation.

It would be advantageous to provide an improved ironing board. It is therefore an aim of the present invention to provide an improved ironing board that addresses one of the above or other disadvantages. In particular, although not exclusively, it is an aim to provide an improved ironing board that can be opened and collapsed in a more user friendly manipulation.

SUMMARY OF THE INVENTION

According to the exemplary embodiments there is provided an ironing board having an upwardly extending support. A board and the upwardly extending support are connected to rotate about a pivot that is fixed relative to both the board and the upwardly extending support and wherein the pivot is arranged so that the board is able to rotate about the upwardly extending support between a stowed orientation and an ironing orientation. Advantageously, by providing an upwardly extending support that enables the ironing board to be self-supporting, the pivot is supported during an opening and collapsing manipulation to rotate the board between the stowed and ironing orientations. In the stowed orientation, the board is arranged generally parallel to the upwardly extending support. In the ironing orientation, the board is arranged generally horizontally. Since the pivot between the board and upwardly extending support does not include a relative sliding movement, the manipulation to open and collapse the ironing board is a rotational movement thus there is reduced tendency to change grip and the user convenience is therefore improved. In particular, because the rotation point between the board and upwardly extending support is both self-supported by the upwardly extending support when the ironing board is in the collapsed orientation and fixed in relation to the upwardly extending support that provides said support, the user does not need to support the rotation point when manipulating the board from and to the stowed orientation. This reduces the effort required to manipulate the ironing board between the ironing and stowed orientations.

In exemplary embodiments, the board is locked in the ironing orientation by a locking mechanism. Suitably, the locking mechanism prevents rotation of the board about the upwardly extending support towards the stowed orientation. The locking mechanism is releasable to allow collapsing of the ironing board when required.

In exemplary embodiments, the ironing board includes a collapsible support. The collapsible support supports the ironing board when manipulated into the ironing orientation. When manipulating the board from the ironing orientation to the stowed orientation, the collapsible support is arranged to collapse. Suitably, it the stowed orientation, the collapsible support is collapsed and arranged between the board and upwardly extending support. In one exemplary embodiment, the collapsible support comprises a support strut. The support strut acts between the board and an anchor. Suitably the support strut is connected to the board at a location spaced from the connection between the board and the upwardly extending support. Preferably, a locking mechanism acts to lock the support strut in a fixed position relative to the board and the upwardly extending support. Advantageously, the support strut provides increased support to the board to prevent movement or deflection during ironing. In exemplary embodiments, the upwardly extending support provides the anchor to the support strut. Suitably, at least one of the connections between the strut and board or the strut and anchor are pivots that are fixed relative to said parts. In one exemplary embodiment, the strut extends between the board and the upwardly extending support and is connected between the board and upwardly extending support by pivot connections. In an exemplary embodiment, both the pivot connections between the strut and board and the strut and upwardly extending support are fixed relative to the respective parts. In an example arrangement, the strut may comprise a first strut part and a second strut part and the first and second strut parts are connected at an elbow. The elbow bends to allow the ironing board to collapse.

In an example arrangement including a support strut and an elbow, a locking mechanism is suitably used to prevent the elbow bending. Suitably, the elbow comprises a pivot connection and the locking mechanism may comprise arranging the pivot axis of the elbow to be arranged in a straight line when the board is deployed to the ironing position. Here, the board, upwardly extending support and strut form a linkage. And the linkage forms a mechanical lock until a force is applied to break the elbow and thus move the elbow's pivot axis away from a straight line. However, preferably, the elbow provides an over-centre lock. Here, the linkage is arranged to rotate the elbow joint past the straight line position. Abutment between the first strut part and the second strut part may prevent further rotation of the elbow which would lead to the board rotating towards the stowed position. In use, forces acting on the board in the downward direction are braced by the abutment. To release the over-centre locking mechanism, the elbow can be broken to move the pivot point back past the straight line position so that the board can be collapsed.

By arranging the upwardly extending support to be self-supporting, the ironing board can be manipulated without the user directly supporting the upwardly extending support. The upwardly extending support may be said to be self-supporting if, in the stowed position, the centre of gravity is positioned above a footprint of the ironing board in a longitudinal direction transverse to an axis of rotation between the board and upwardly extending support. Here, the footprint is the area bounded between points of contact between the ironing board and ground. The user can therefore concentrate on performing a manipulation to rotate the board. As the board rotates to the ironing orientation, the weight distribution of the ironing board may shift. Also, during an ironing process, forces exerted on the board create changes to the centre of gravity. Consequently it is preferable to provide a stabilising leg.

In an example arrangement, there is provided a stabilising leg. The stabilising leg is suitably arranged to be deployed automatically as part of the opening manipulation of rotating the board. Here, the stabilising leg can be connected to the board and upwardly extending support to form a mechanical linkage. The mechanical linkage may include a support strut. For instance, the support strut as described in relation to exemplary embodiments. Here, the stabilising leg and support form a collapsible support. In an example arrangement, the stabilising leg is connected to the upwardly extending support and the support strut via pivot connections. One or both of the pivot connections may slide in relation to one or both respective parts so that the movement of the support strut drives movement of the stabilising leg. In an example arrangement, the stabilising leg is arranged in a parallel orientation to the upwardly extending support when the ironing board is in the stowed orientation. By pivotally connecting the stabilising leg to the upwardly extending support, the stabilising leg rotates relative to the upwardly extending support so that a lower end of the stabilising leg moves away from the upwardly extending support. In an example arrangement, the pivot between the stabilising support and the upwardly extending support is able to slide relative to the upwardly extending support so that the lower end of the stabilising leg moves in a plane. The plane is substantially orthogonal to the upright support so that the lower end of the stabilising leg moves across the ground when the upright support is self-supported. The stabilising leg therefore expands the footprint of the ironing board increasing the stability. The end of the stabilising leg may include a wheel or roller so that it rolls along the ground in use.

In an example arrangement, there is provided a second support strut. The second support strut can be connected to the upwardly extending support and the stabilising leg. Here, the second support strut, stabilising leg and support strut as described above form a collapsible support.

It is desirable to provide ironing boards with variable height positions for the board when the ironing board is opened in the ironing orientation. In an example arrangement, height adjustment includes the upright support being telescopic. Thus the distance between the fixed pivot connecting the board and upwardly extending support and a base of the upwardly extending support is variable. When the board is opened to the ironing position, changing said distance moves the board in a generally parallel orientation between two or more heights. Suitably, a telescopic upwardly extending support comprises a first section and a second section. The first and second sections are restrained to slide relative to each other in one axis. For instance, an axis corresponding to a longitudinal axis of the upright support. A lock is provided to selectively lock the first and second telescopic parts relative to each other in different extensions and to thereby provide the change in said distance. In example arrangements including a collapsible support, for instance a stabilising leg, support strut and second support strut, the connections between the upwardly extending support and the collapsible support are fixed to one of the first or second sections only.

Here, the collapsible support may remain in a rigid arrangement as the telescopic upwardly extending support changes length. To accommodate the change in length, the stabilising leg is arranged to correspondingly change distance in said direction between the pivot connection to the upwardly extending support and the plane representing the ground. Preferably, the second support strut is pivotally attached to a lower portion of the upwardly extending support and the centre of the stabilising leg. This configuration ensures that as the height of the pivot is adjusted, by extending or lowering the telescopic upwardly extending support, the position of the stabilising leg is simultaneously adjusted so that the ironing board is horizontal in various height positions.

In example arrangements wherein the stabilising leg accommodates movement of the telescopic parts, the pivot between the stabilising leg and support strut is suitably arranged to slide relative to the support strut or stabilising leg. The end of the stabilising leg can therefore move in a plane corresponding to the ground. Here a lock is provided to selectively lock the pivot relative to the respective part. Preferably, said pivot slides relative to the support strut. When the lock of the telescopic upwardly extending support and the lock on the sliding pivot between the stabilising leg and support strut are released, the rotation point between the upwardly extending support and board can be raised or lowered. During raising or lowering of the board, the board's rotation relative to the upwardly extending support remains fixed. Thus the user may concentrate on the raising and lowering manipulation and does not have to be concerned with maintaining the angular orientation of the board.

Suitably, the ironing board is portable in its stowed orientation. In some example arrangements there is therefore provided a transportation wheel on the base of the upwardly extending support in order to increase the portability of the ironing board. The transportation wheel may form a contact point for the footprint of the upwardly extending support. Here, a spaced portion of the upwardly extending support provides a second, spaced contact point for the footprint of the upwardly extending support. The transportation wheel can be operated by tilting the upwardly extending support so the second spaced contact is raised clear and the wheel operated. Suitably the transportation wheel comprises first and second wheels spaced on a common axis that is orthogonal to the longitudinal extent of the board in the ironing orientation.

Suitably, the upwardly extending support has a longitudinal extent. In exemplary embodiments, the longitudinal extent is arranged to be substantially vertical relative to the ground on which the ironing board is rested and when self-supported. In the stowed orientation, the board may be spaced from the upwardly extending support. Here, the collapsible support can be stowed in the space between the board and upwardly extending support. In exemplary embodiments, the pivot between the board and upwardly extending support is arranged to provide the spaced relationship. In one embodiment, the upwardly extending support includes a projection angled to the longitudinal extent, and the pivot is arranged on the projection.

In example arrangements, the pivot between the board and the upwardly extending support is spaced from an end of the board. Here, the board extends to either side of the upwardly extending support when the board is arranged in the ironing orientation.

Optionally, the ironing board may be provided with an air-movement system to suck or blow air into/from a cavity under the board. Here, an ironing surface of the board is connected to the cavity through apertures in the board. The air-movement system can be used for suction to intensify a steam function of the iron. Or for blowing through the ironing surface for a gentle soothing of the fabric. Air-movement systems are known including an air-movement device for moving the air as required. In example arrangements, the upwardly extending support provides a convenient location for the air movement device. By locating the air-movement device in the upwardly extending support, an air connection can be achieved between the chamber of the board and the air-movement device by abutment of the board and upwardly extending support during the manipulation process from the stowed to ironing orientations. Because the pivot between the board and upwardly extending support does not slide, the respective parts abut through a rotational movement. The repeatability of the parts abutting is therefore improved as compared to achieving an air connection between two parts that both rotate and slide respectively to each other.

Optionally, in some example arrangements, the ironing board includes a power connector allowing an iron to be connected to the ironing board. In the example arrangement, the ironing board further includes a power cable for connecting the connector to a mains power supply. Thus the ironing board can be located a distance from a power socket, without being restricted by the cable length provided by the iron.

Here, a cable spool may be provided. The cable spool includes a spool for winding the power cable. Suitably, the spool can be located in the upwardly extending support, and preferably in the lower end of the upwardly extending support to avoid dangling cables. In an example arrangement, the cable spool is rotatable to wind the power cable onto the cable spool.

According to another aspect of the invention, there is provided an ironing board comprising: a board having an upper surface on which garments are placed for ironing; and an elongate support to which the board is mounted; wherein a pivot pivotally connects the board to the elongate support, the pivot being arranged so that, when the elongate support is positioned on a supporting surface in an upstanding orientation, the board is rotatable about the pivot, whilst the elongate support remains fixed in said upstanding orientation, between a stowed position in which the board lies in an upstanding orientation adjacent to the elongate support, and in which the upper surface of the board faces away from the elongate support, and an ironing position in which the board extends at an angle relative to the elongate support, to enable garments to be ironed on said upper surface. The ironing board according to this aspect may have the same collapsible support structure and other features referred to in conjunction with the previous aspect.

BRIEF DESCRIPTION OF THE DRAWINGS

Exemplary embodiments are described with reference to the accompanying drawings, in which.

Reference will now be made in detail to the embodiments of the present invention, examples of which are illustrated in the accompanying drawings, wherein like reference numerals refer to like and interchangeable elements throughout.

DETAILED DESCRIPTION OF THE EMBODIMENTS

Figure 1:
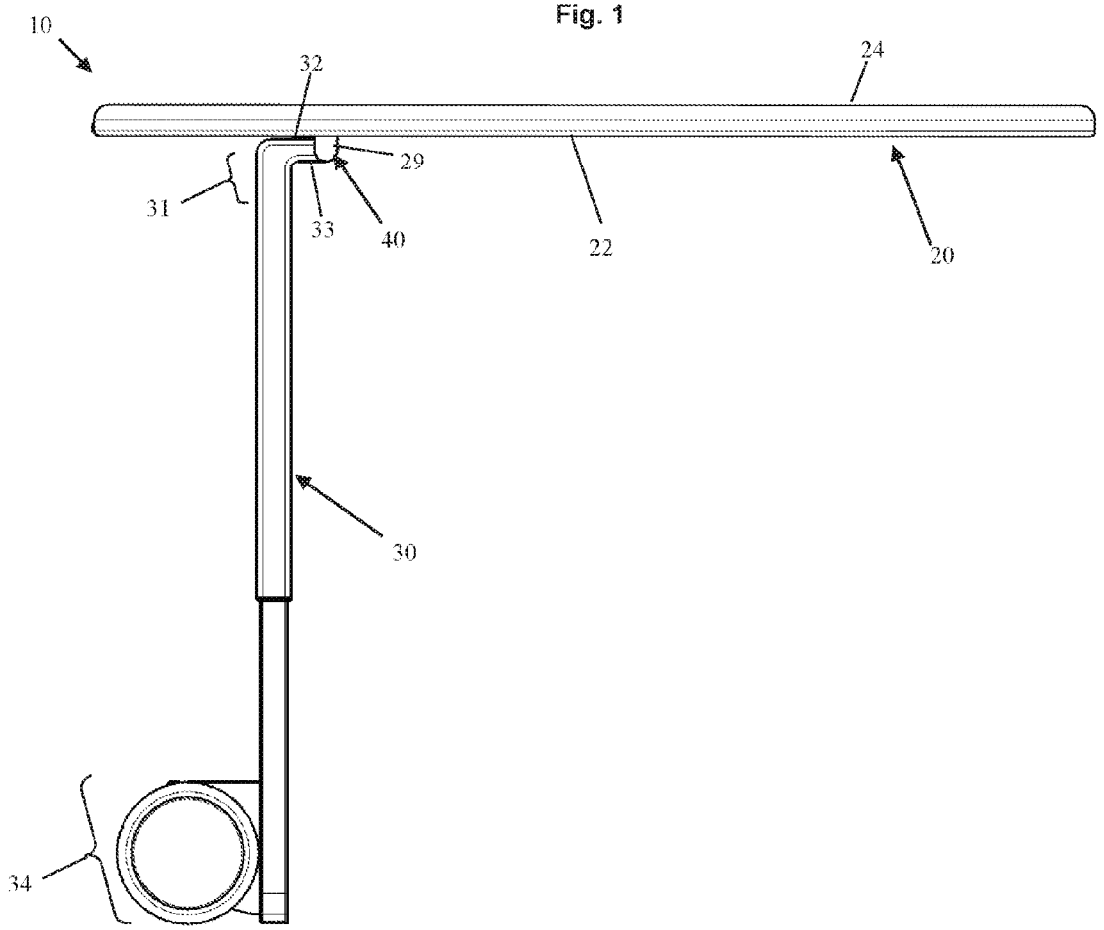
FIG. 1 shows a side view and top view of an ironing board according to an exemplary embodiment in an ironing orientation.
Figure 1:
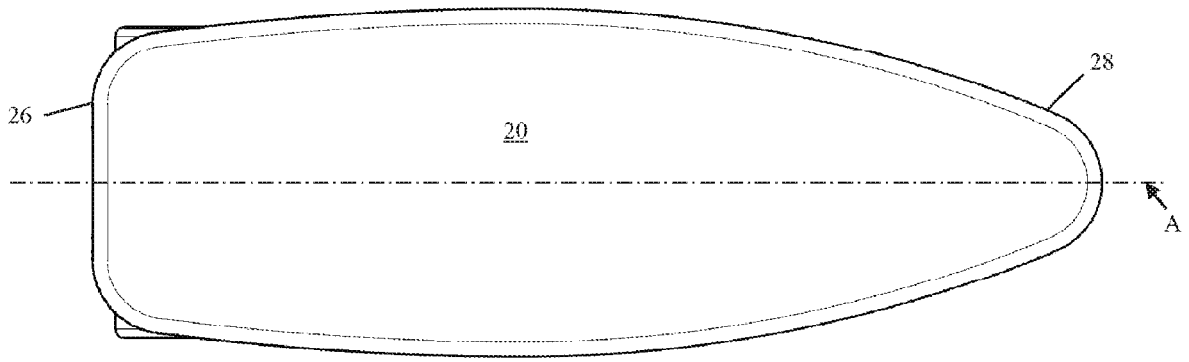

FIG. 1 shows an exemplary ironing board 10. The ironing board 10 comprises a board 20 and an upwardly extending support 30.

The board 20 may take a form as is known in the art. For instance, the board includes an underside 22 and a top, flat, ironing face 24. As is known in the art, the board 20 may be solid or may be a perforated sheet of metal, covered with a cover and padding layer. Alternatively, as described herein, the board 20 may be hollow with a perforated ironing face to allow steam generation/extraction through the board. As shown in the top view, the board 20 may have a broad end 26 and an opposed end 28. The board 20 has a longitudinal extent running lengthwise between the nose end and broad end as depicted by longitudinal axis A in FIG. 1. The board 20 is generally symmetrical about the longitudinal axis. Moreover, a width of the board 20 is taken in a direction orthogonal to the longitudinal axis. Whilst the following description makes reference to the broad end 26 and nose end 28, the shape of the board is not limiting. Furthermore, it will be appreciated that various changes and adaptions to the board may be made as is known in the art without affecting the board's function of providing a horizontal ironing surface. Here, horizontal relates to the intended plane of the board, and in particular the ironing face 24, when the ironing board is arranged in an ironing orientation and is in reference to an ideal ground within general installation and manufacturing tolerances known in the art.

Figure 2:
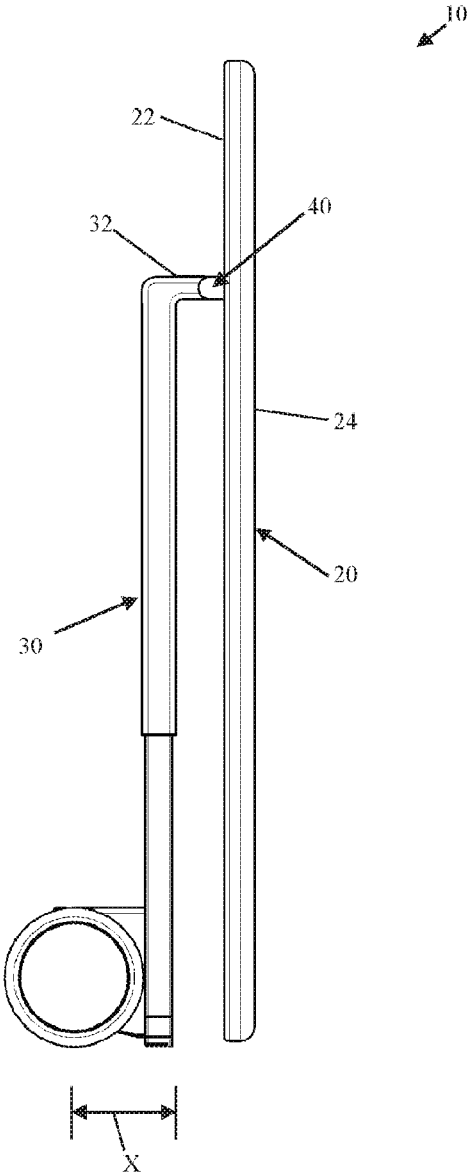
FIG. 2 shows a side view of the exemplary ironing board of FIG. 1 in a stowed orientation.

The board 20 and the upwardly extending support 30 are connected to each other via a pivot 40. The pivot 40 allows the board 20 to rotate relative to the upwardly extending support 30 between the ironing orientation, as shown in FIG. 1, and a stowed orientation as shown in FIG. 2. In the stowed orientation, the ironing board 10 is more compact and suitable for more convenient storing than in the ironing orientation. The pivot 40 has a pivot axis that is parallel to the ironing surface and extends in a width direction. Thus the board rotates between the ironing orientation and the stowed orientation about a generally horizontal axis and so that the longitudinal axis of the board follows a generally vertical plane. In the ironing orientation the ironing face of the board is arranged in a generally horizontal plane. As shown in FIG. 2, suitably, in the stowed orientation, the ironing face 24 of the board 20 is arranged in a generally vertical plane.

As shown in FIG. 1, the pivot 40 is arranged towards an upper end 31 of the upwardly extending support 30. It will be appreciated the location of the pivot 40 on the upwardly extending support 30 is a determination factor of the height of the ironing surface 24 when the ironing board is manipulated to the ironing orientation. In the exemplary embodiments, the pivot 40 is a fixed pivot. That is, a pivot axis of the pivot 40 does not move relative to the board 20 or the upwardly extending support 30. The pivot 40 therefore provides a rotational joint only, without a sliding function relative to the parts that it connects. The pivot 40 may comprise any suitable connection between the board 20 and upwardly extending support 30. For instance, the pivot 40 may comprise a pin cooperating with a hole in one or both parts, with the pin acting as an axle or stub axle about which the part or parts rotate. As will be appreciated, the pivot 40 may include two connections providing a common pivot axis and, for instance, arranged on either side of the longitudinal axis of the board to provide improved widthwise stability.

The pivot's 40 axis is arranged to allow the board to be stowed relative to the upwardly extending support 30 compactly. Suitably as shown in FIG. 2, the board is stowed spaced by a gap relative to the upwardly extending support 30. As will be explained with reference to other exemplary embodiments, the gap provides a convenient location to accommodate other parts of the ironing board. However, by spacing the pivot from the upwardly extending support 30, at least relative to a major extent, the upwardly extending support 30 also provides an abutment surface 32. Here, the abutment surface may abut the underside 22 of the board 20. Said abutment providing a convenient location for a connection between the board and upwardly extending support, as will be described in relation to other exemplary embodiments, and also acts to provide a mechanical support for the board 20 when in the ironing orientation. Suitably, the abutment surface 32 is formed by a projection 33 formed at a distal end of the upwardly extending support 30. The projection 33 extends generally horizontally and is shown as a 90° knuckle formed at an upper end of the upwardly extending support 30. For the board to abut the abutment surface 32, the pivot 40 is connected to the board 20 at a location along the longitudinal axis of the board 20 spaced from the broad end 26. Thus the board 20 extends to either side of the pivot 40. Suitably as shown, the pivot 40 is spaced from the broad end 26 so that the board extends past the abutment surface 32 in the ironing orientation. As shown the board 20 may include lugs 29 that extend from the underside 22 of the board and on which the pivot 40 is located.

The upwardly extending support 30 is self-supporting. That is, when arranged on a level, horizontal ground, the upwardly extending support 30 is able to remain in an upright position when the ironing board 10 is in the stowed orientation and without external support or forces retaining it in the upright position. Here, the center of gravity of the ironing board is arranged over a footprint of the ironing board 10 in contact with the ground. The footprint is defined by the extent of contact locations. The footprint in a thickness direction is the separation of contact locations in the direction orthogonal to the pivot's axis. It will be appreciated that this will be in the longitudinal direction of the board when the board is in the ironing orientation. In FIG. 2, the footprint in the thickness direction is shown by arrow X. Here, the board 20 is not shown in contact with the ground. It will be appreciated that in an example where the board 20 is in contact with the ground the nose of the board 20 is a contact location which increases the footprint of the ironing board 10. The footprint of the ironing board in the thickness direction is therefore the footprint of the upwardly extending support 30. It will be appreciated that if the board or another part of the ironing board contacts the ground in the stowed orientation, that contact may extend the footprint of the ironing board in the thickness direction if that contact is outside the upwardly extending support's footprint. Suitably, when in the stowed orientation, the axis of the pivot 40 is arranged at a height from the ground less than ten times the footprint in the thickness direction or less than six times the footprint in the thickness direction. It will also be appreciated the center of gravity of the ironing board in a widthwise direction, coincident with pivot axis, also remains over the footprint of the ironing board in the width direction. In the exemplary embodiments, and generally in the art, the ironing boards are arranged to be substantially symmetrical about a widthwise center and consequently have a center of gravity substantially towards the center of a widthwise footprint in both the stowed and ironing orientations.

To increase the footprint in the orthogonal direction, the upwardly extending support may have a bulbous lower region 34. The bulbous lower region 34 allows the major extent of the upwardly extending support to remain compact in the thickness direction. The bulbous lower region 34 may also provide convenient location for further parts as will be described in relation to further exemplary embodiments.

Therefore, the ironing board 10 may be self-supporting, in the sense that the upwardly extending support 30 remains in an upright position when the ironing board 20 is in its stowed position, i.e. one (lower) end of the upwardly extending support 30 rests on a level, or substantially level, ground or floor surface with the upwardly extending support 30 extending or upstanding substantially perpendicular to the level surface. The ironing board 10 will remain in this position and need not be held by a user, or leant against a wall or other supporting surface when the board 20 is in its stowed position. It will be understood that only the lower end of the upwardly extending support 30 may be in contact with the ground when the board 20 is in its stowed position. However, in addition to the lower end of the upwardly extending support 30, the lower end of the stabilising leg 60 may also be in contact with the ground when the board 20 is in its stowed position. In addition to, or as an alternative, to the lower end of the stabilizing leg 60 being in contact with the ground, one end of the board 20 may contact the ground. If the stabilizing leg 60 and/or the nose of the board 20 are in contact with the ground, in addition to the lower end of the upwardly extending support 30, the footprint or area in contact with the ground increases, thereby providing more stability to the ironing board 20 and further improving its ability to be self-supporting in a stowed orientation. However, adequate support is provided when only the lower end of the upwardly extending support remains in contact with the ground when the board is in its stowed orientation. Many known ironing boards do not remain upright when collapsed, and instead must be leant against an upright surface or hooked in place to prevent them falling over. In embodiments according to the present invention, the upwardly extending support remains in the same position relative to the surface on which the upwardly extending support is placed, irrespective of whether the board is in its ironing or stowed positions, and supports the board on the floor in both positions without falling over. This also means that the ironing board can be opened easily, by simply pivoting the board into its ironing position relative to the upwardly extending support, without changing the position of the upwardly extending support.

When self-supported, the upwardly extending support 30 provides a support to the pivot 40 with the pivot supported spaced from the ground at a height suitable for ironing. Suitably, the upwardly extending support 30 is shown in the exemplary embodiment as an upright. That is, the upwardly extending support 30 has a generally longitudinal extent that is arranged substantially vertically. Here, vertically means the intended plane of the upwardly extending support 30 when self-supported in the stowed orientation and is in reference to an ideal ground within general installation and manufacturing tolerances known in the art.

In the exemplary embodiments, a lock is provided to restrict the relative rotation between the board 20 and upwardly extending support 30. The lock is deployable to hold the board in the ironing orientation. In the exemplary embodiments with the upwardly extending support 30 being an upright, the board is held at a perpendicular orientation to the upright in the ironing orientation. The lock is releasable to allow the board to rotate to the stowed orientation wherein the board 20 and upright 30 are substantially parallel. Thus from the ironing orientation, releasing the lock and rotating the board 20 downwardly about an angle of 90°, manipulates the board 20 to the stowed orientation.

Figure 3:
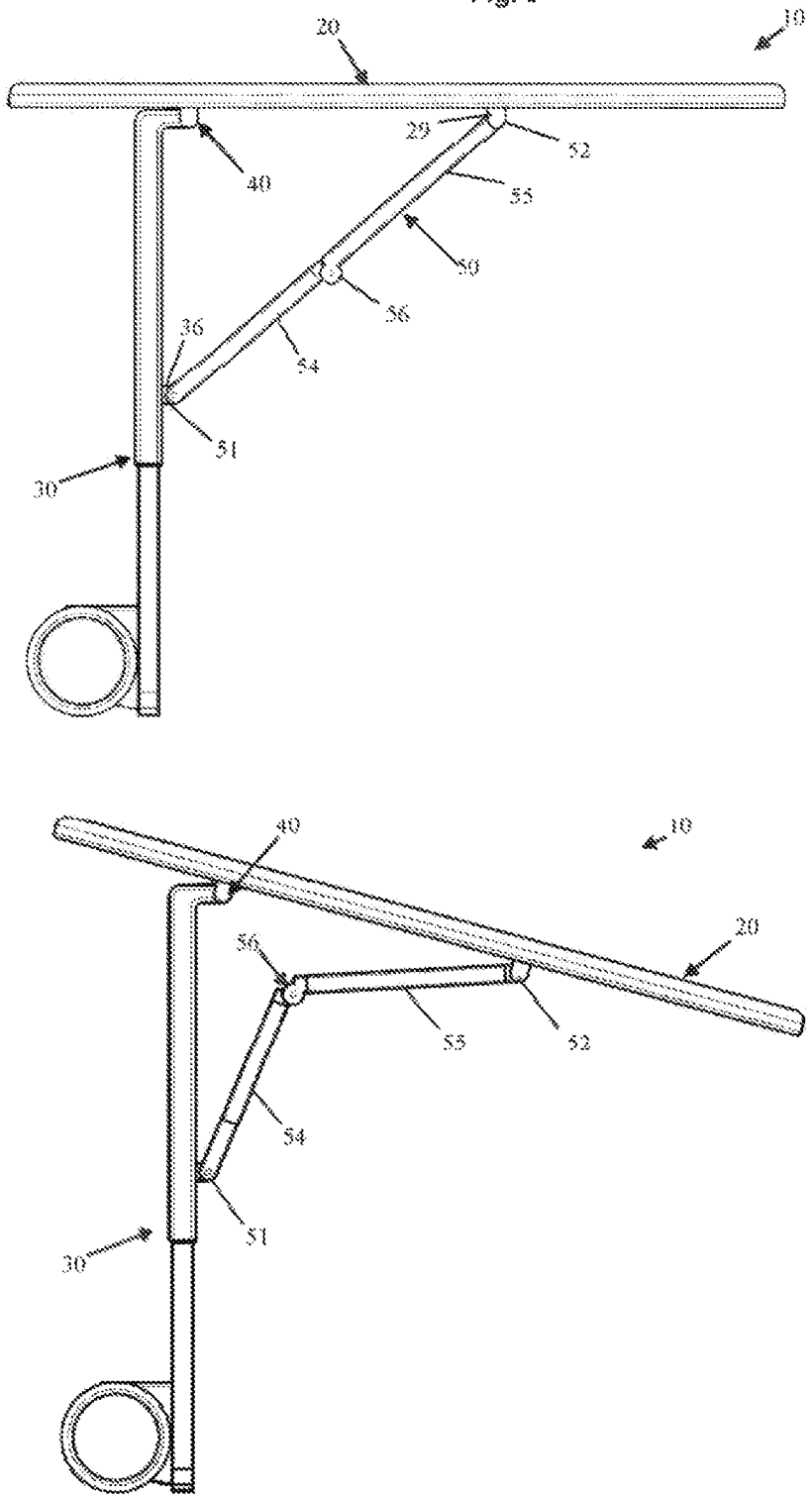
FIG. 3 shows side views of an ironing board according to an exemplary embodiment including a support strut and in an ironing orientation and at a manipulation between the ironing orientation and a stowed orientation.

During an ironing process, external forces are exerted on the board 20 and typically in a downwards direction. It will be appreciated that the downward forces act to rotate the board 20 about the pivot 40 and which the lock counteracts so the board can provide a stable ironing surface. FIG. 3 shows an exemplary embodiment wherein the ironing board 10 further includes a support strut 50. The support strut 50 is deployable to support the board 20 against an anchor 51, when the ironing board 10 is in the ironing orientation. As shown in FIG. 3, the anchor 51 suitably acts against the upwardly extending support 30, and is shown as a lug 36 that extends from the upwardly extending support.

In the exemplary embodiment, the support strut 50 fixes a length between the anchor 51 on the upwardly extending support 30 and a second anchor 52 fixed in relation to the board 20. The pivot 40 between the board 20 and upwardly extending support 30 is therefore mechanically braced. By releasing the support strut 50 so that the distance between the first and second anchors 51, 52 are variable, the support strut 50 assists or preferably provides the lock restricting the relative rotation between the board 20 and upwardly extending support 30. The first and second anchors 51, 52 are shown as pivots between the support strut 50 and respective board 20 and upwardly extending support 30. The pivots are suitably located on lug 36 and a lug 29 extending from the respective parts. In the exemplary embodiments, the pivots are fixed respectively relative to the support strut 50 and board 20 and the support strut 50 and upwardly extending support 30. Here, when the support strut 50 is released, the support strut enables the length between the anchors to vary. For instance, suitably, the support strut comprises a first strut part being a first link 54 and a second strut part being a second link 55 that are joined by an elbow 56. Here, the elbow bends to allow the strut 50 to collapse.

In the exemplary embodiments, the elbow 56 provides an over-center lock. Here, the elbow's pivot axis is arranged to rotate past a straight line between the anchors 51, 52. An abutment, for instance between the first 54 and second 55 links, prevents further rotation. When a force acts on the board 20 to urge downward rotation about the pivot 40, the elbow is urged to further bend against the abutment. The abutment therefore provides a mechanical lock bracing the board and upwardly extending support 30. When the elbow 56 is broken, for instance by applying an external force to move the pivot back past the straight line position between the anchors 51, 52, the elbow 56 is urged to continue bending to collapse the support strut 50 such that the board 20 can rotate about the pivot 40 and return to the stowed position.

To enable the support strut 50 to be stowed compactly, the first link 54 and second link 55 are suitably connected by the elbow 56 to be stowed parallel to each other. That is, the elbow 56 is arranged to rotate about an angle of over 180° from the stowed orientation to the ironing orientation. It will be appreciated the support strut 50 can be arranged to be stowed between the board 20 and upwardly extending support 30. Conveniently, the first and second parts are rods or bars having a height across the pivot axis. Here, the elbow 56 is formed on or around a corner edge of the first and second parts. Thus, end faces of the first and second parts abut when the strut is extended with the first and second parts extending coaxially. By arranging the pivot axis at the anchors at a center of the first and second parts or on an opposed edge, the elbow moves to an over-center position when the first and second parts are coaxial.

Figure 4:
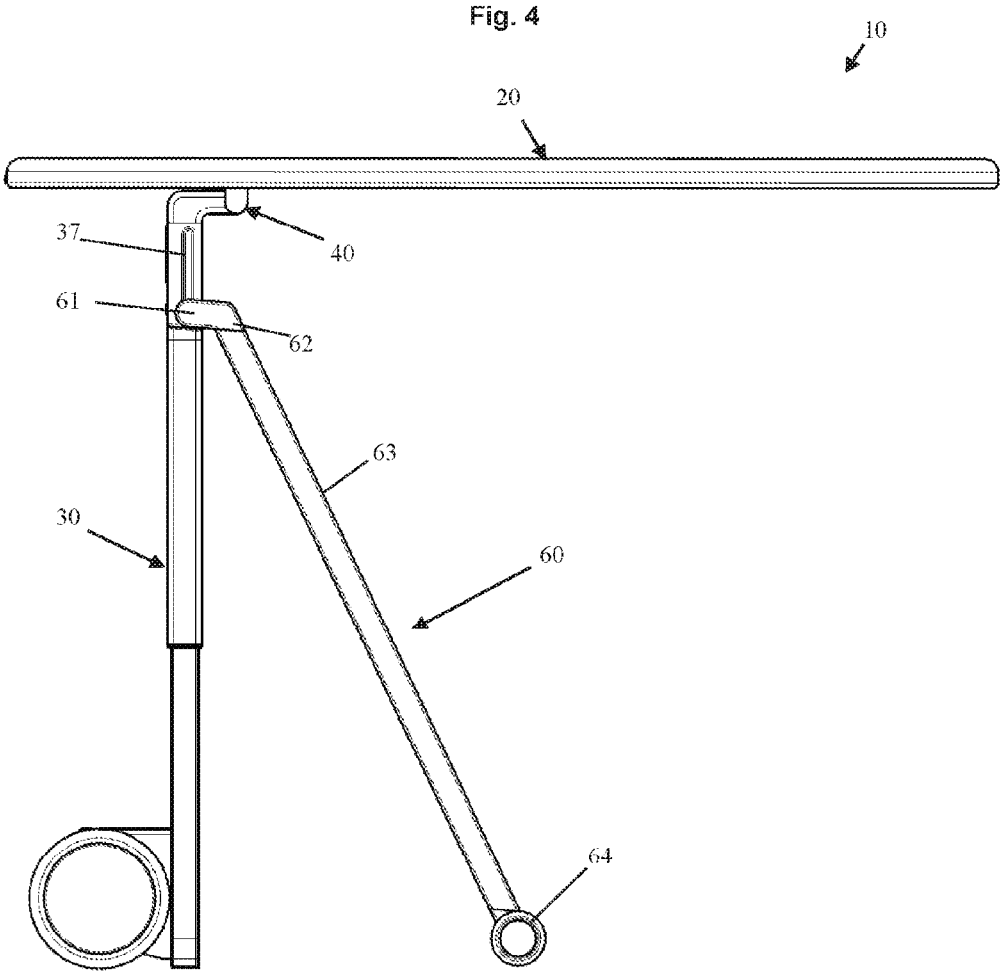
FIG. 4 shows a side view of an ironing board according to an exemplary embodiment including a support leg and in an ironing orientation.

The external forces coupled with the change in center of gravity from the change in orientation of the board 20 and other parts during manipulation to and when manipulated in the ironing orientation also act to destabilize the upwardly extending support 30. Referring to FIG. 4, an exemplary ironing board 10 is shown further including a stabilising leg 60. The stabilising leg is arranged to extend from the upwardly extending support 30 when the board 20 is rotated about the pivot 40 towards the ironing orientation. The stabilising leg 60 is shown as being pivotally connected to the upwardly extending support at pivot connection 61. Here, the stabilising leg 60 comprises a connection end 62 and an elongate member 63. The elongate member 63 has an elongate extent and is shown suitably as a rod or bar. The connection end 62 forms one end of the elongate member 63 and may project from the elongate member so as to arrange the pivot axis away from a longitudinal axis of the elongate member so that the elongate member may be stowed generally parallel to and substantially flat against the upwardly extending support 30. The stabilising leg 60 is rotatable relative to the upwardly extending support 30 from a stowed orientation, wherein the elongate member 63 is substantially parallel to the upwardly extending support 30, to a deployed orientation wherein the elongate member 63 is arranged at an angle to the upwardly extending support 30. A distal end 64 of the stabilising leg is arranged to contact the ground and therefore support the ironing board 10 in the ironing orientation, and in particular, by extending the ironing board's footprint in the thickness direction of the upwardly extending support 30. Suitably, and as described in relation to further exemplary embodiments, the rotation of the stabilising leg 60 is linked to the rotation of the board 20 about the pivot 40 so that the stabilising leg is automatically deployed.

Suitably, the pivot connection 61 is not fixed relative to one of the stabilising leg 60 or upwardly extending support 30. As shown, the pivot connection 61 is arranged to slide relative to the upwardly extending support 30. Here, a slot 37 may be provided in the upwardly extending support 30 and the pivot connection 61 arranged to slide within the slot 37. This sliding movement accommodates the change in distance between the ground and the axis of the pivot connection 61 as the stabilising leg rotates between the stowed and deployed orientations. For instance, by allowing the stabilising leg 60 to slide and simultaneously pivot relative to the upwardly extending support, the distal end 64 can subtend a linear plane corresponding to the ground. Thus the stabilising leg provides support as the stabilising leg is deployed to resist the upwardly extending support 30 from toppling. To assist the distal end 64 from running along the ground, a roller or wheel may be provide at the distal end 64. Suitably, therefore the stabilising leg rotates outwardly from the upwardly extending support underneath the board 20 and so that the stabilising leg, and in particular, the elongate member 63, is stowed between the board 20 and the upwardly extending support 30.

Figure 5:
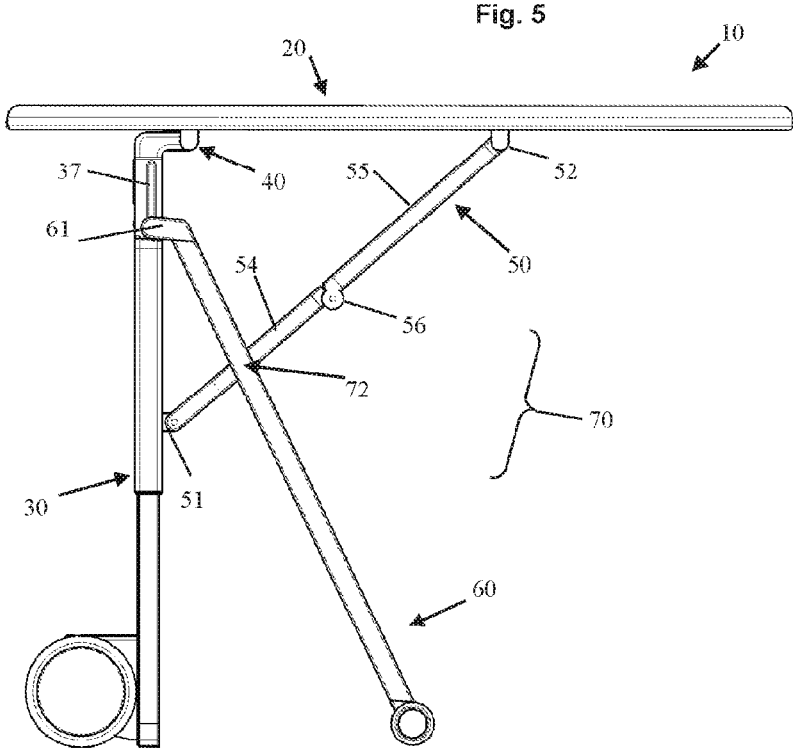
FIG. 5 shows side views of an ironing board according to an exemplary embodiment including a collapsible support in an ironing orientation and at a manipulation between the ironing orientation and a stowed orientation.
Figure 5:
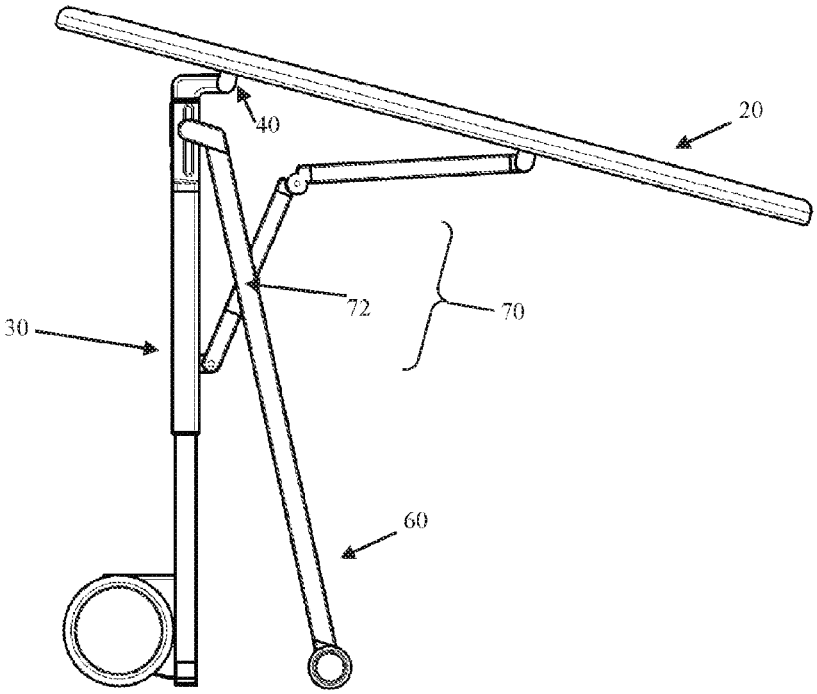

In exemplary embodiments, the ironing board 10 suitably includes a collapsible support 70. Whilst the collapsible support may comprise either the support strut 50 or the stabilising leg 60 of other exemplary embodiments, according to the exemplary embodiment shown in FIG. 5, the collapsible support 70 comprises both a support strut 50 as described above and a stabilising leg 60 as described above. Here the stabilising leg 60 and support strut 50 are pivotally connected at join 72. The collapsible support 70 forms a linkage wherein movement of one of the parts of the linkage drives movement of the linkage. For instance, to manipulate the ironing board 10 from the ironing orientation toward the stowed orientation, the elbow 56 is broken by moving it back past the straight line between the anchors 51, 52. As the first link 54 rotates, the join 72 causes the pivot connection 61 between the stabilising leg 60 and upwardly extending support 30 to slide in slot 37 and simultaneously rotate relative to the upwardly extending support 30. Likewise, the rotation of the second link 55 causes the board 20 to rotate about the pivot 40 rotating the board towards the stowed orientation. As shown in FIG. 5, further rotation of the board 20 about the pivot 40 causes the collapsible support 70 to collapse to a mid-arrangement between the ironing and stowed orientations. Rotating the board about the pivot 40 in one direction causes the linkage of the collapsible support 70 to open back towards the ironing position and rotation in the other direction causes the linkage of the collapsible support 70 to collapse towards the stowed orientation. In the stowed orientation, the collapsible support 70 is arranged between the upwardly extending support 30 and the board 20. In the ironing orientation, the stabilising leg 60 is deployed to provide stability to the ironing face and the support strut 50 is locked in an over-center position to prevent the collapsible support 70 from collapsing.

Figure 6:
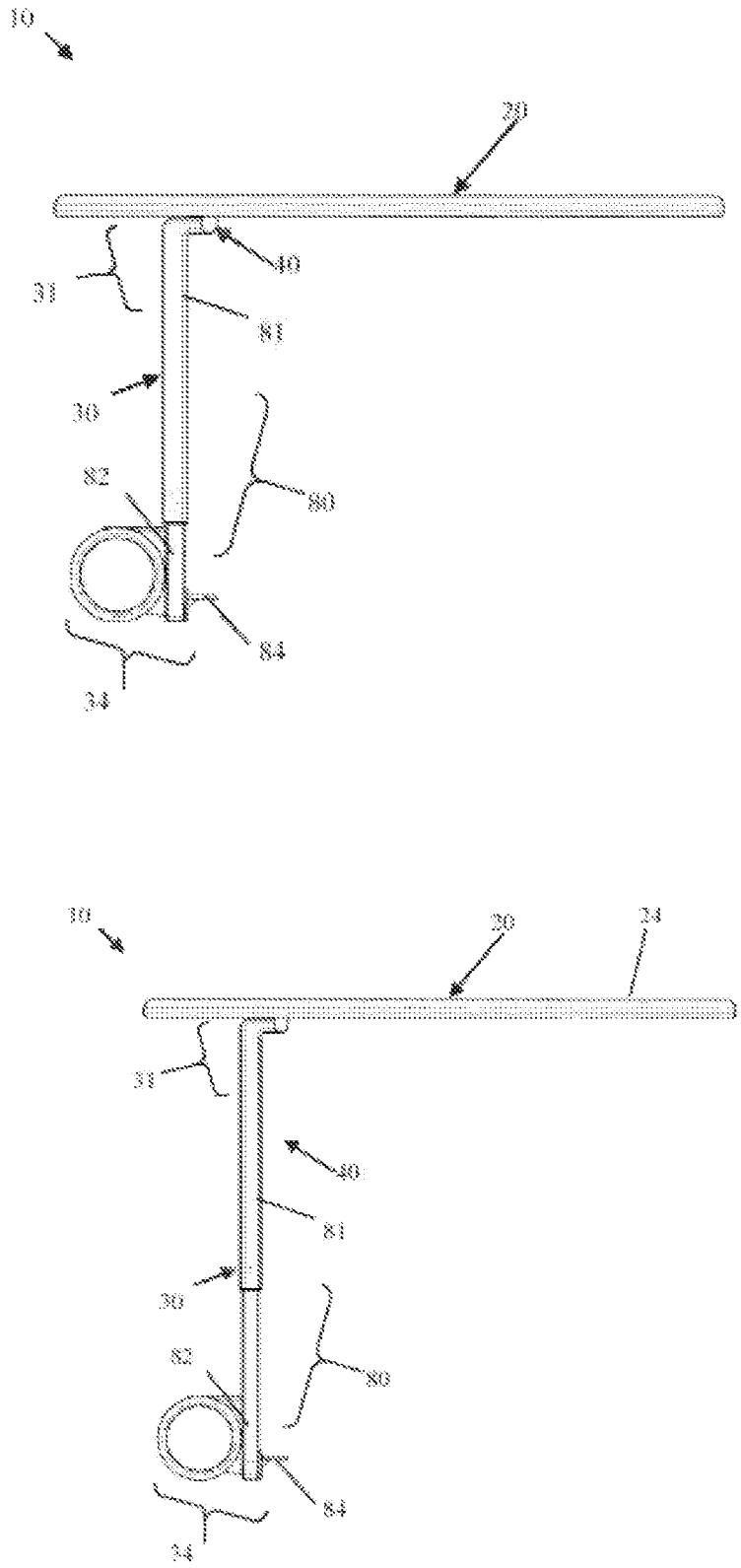
FIG. 6 shows side views of an ironing board according to an exemplary embodiment including a height adjustment mechanism in an ironing orientation and deployed at a first height and a second height.
Figure 10:
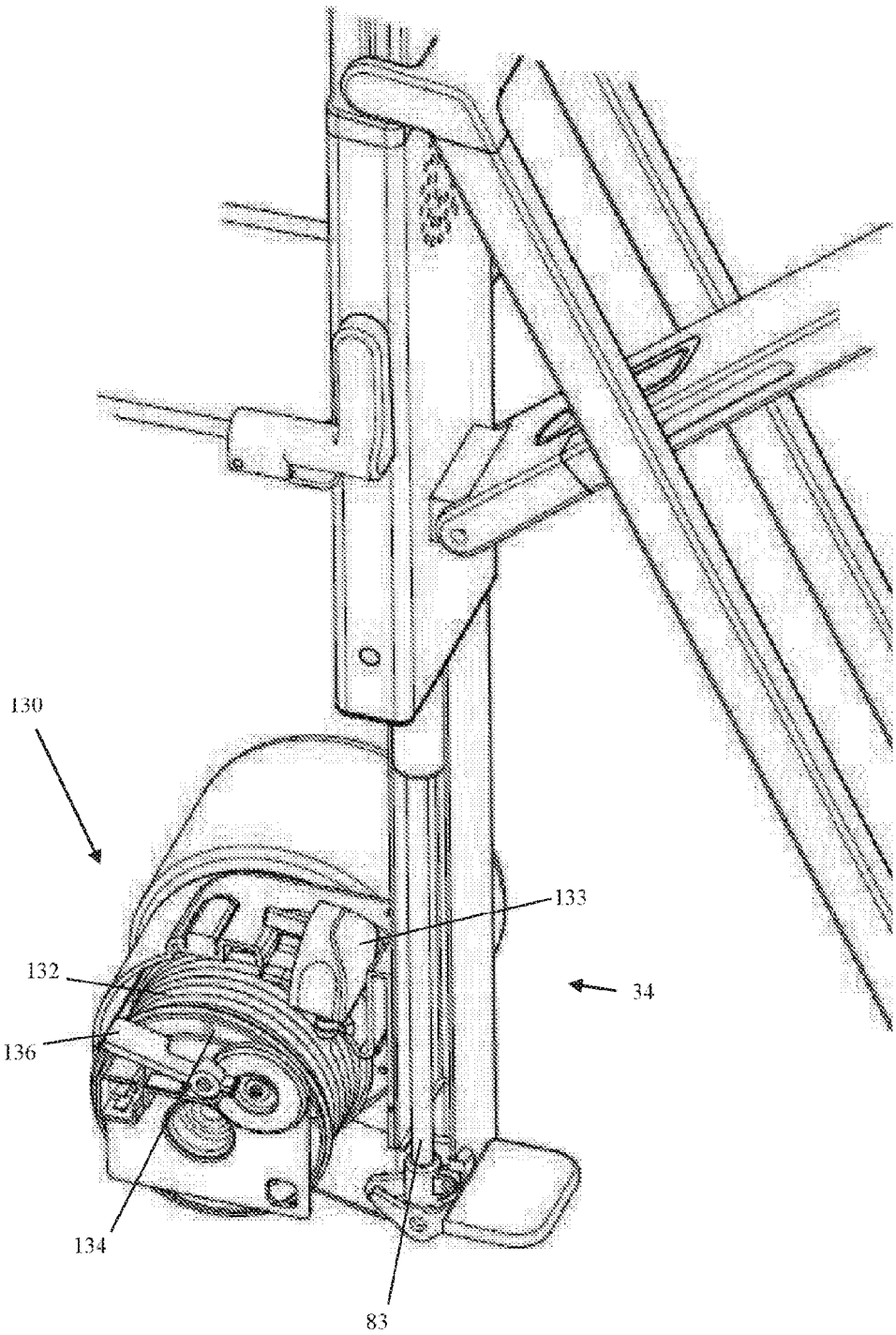
FIG. 10 shows a partial perspective view of a portion of an exemplary ironing board including a power cable spool.

In the exemplary embodiment shown in FIG. 6, the ironing board 10 further includes a height adjustment mechanism 80. Here, the upwardly extending support 30 is shown as being telescopic. Suitably, a telescopic upwardly extending support comprises a main section 81 and a telescopic section 82. One of the sections, shown as the main section 81, includes the upper end 31 of the upwardly extending support 30, and the other of the sections, shown as the telescopic section 82, includes the lower end 34 of the upwardly extending support 30. Consequently, by extending or contracting the telescopic section relative to the main section in a longitudinal axis, the height of the pivot 40 can be varied. The height adjustment mechanism 80 may include a piston to cause the extension or contraction of the telescopic part 82. Referring to FIG. 10, the lower telescopic section 82 is shown sectioned to reveal a piston 83. Suitably, the piston 83 may be spring assisted and may suitably be a gas spring or similar piston. The piston 83 can be released by depressing an actuator shown suitably as a foot pedal 84 located at the lower end of the upwardly extending support. In use, when the board 20 is rotated and locked in the ironing position, the pedal 84 can be depressed to release piston.

Suitably, the ironing board is manipulated between the stowed and ironing orientations with the telescopic upwardly extending support in a maximum extension. Thus, pushing down on the board 20 with the piston released allows the main section 81 and the telescopic section 82 to contract, lowering the height of the ironing surface 24 to a minimum extension of the telescoping parts. The height adjustment may have positions between the minimum and maximum extensions of the telescoping parts and releasing the pedal 84 may lock the telescoping parts in place. Also, the ironing board may be arranged to allow the board to be rotated between stowed and ironing orientations at less than maximum extension of the telescopic section 82 from the main section 81 so that the ironing face can be raised by releasing the pedal 84 and lifting upwardly the board. It will be appreciated that locking the piston locks the telescoping parts in relation to each other. Releasing the piston through operation of the foot pedal is exemplary and once released, the optional spring assisted piston aids the movement of the telescopic part 82 relative to the main part 81 to either extend or contact the telescoping upwardly extending support 30. During operation of the height adjustment mechanism 80, the board 20 suitably remains locked in orientation relative to the telescopic upwardly extending support 30.

Figure 7:
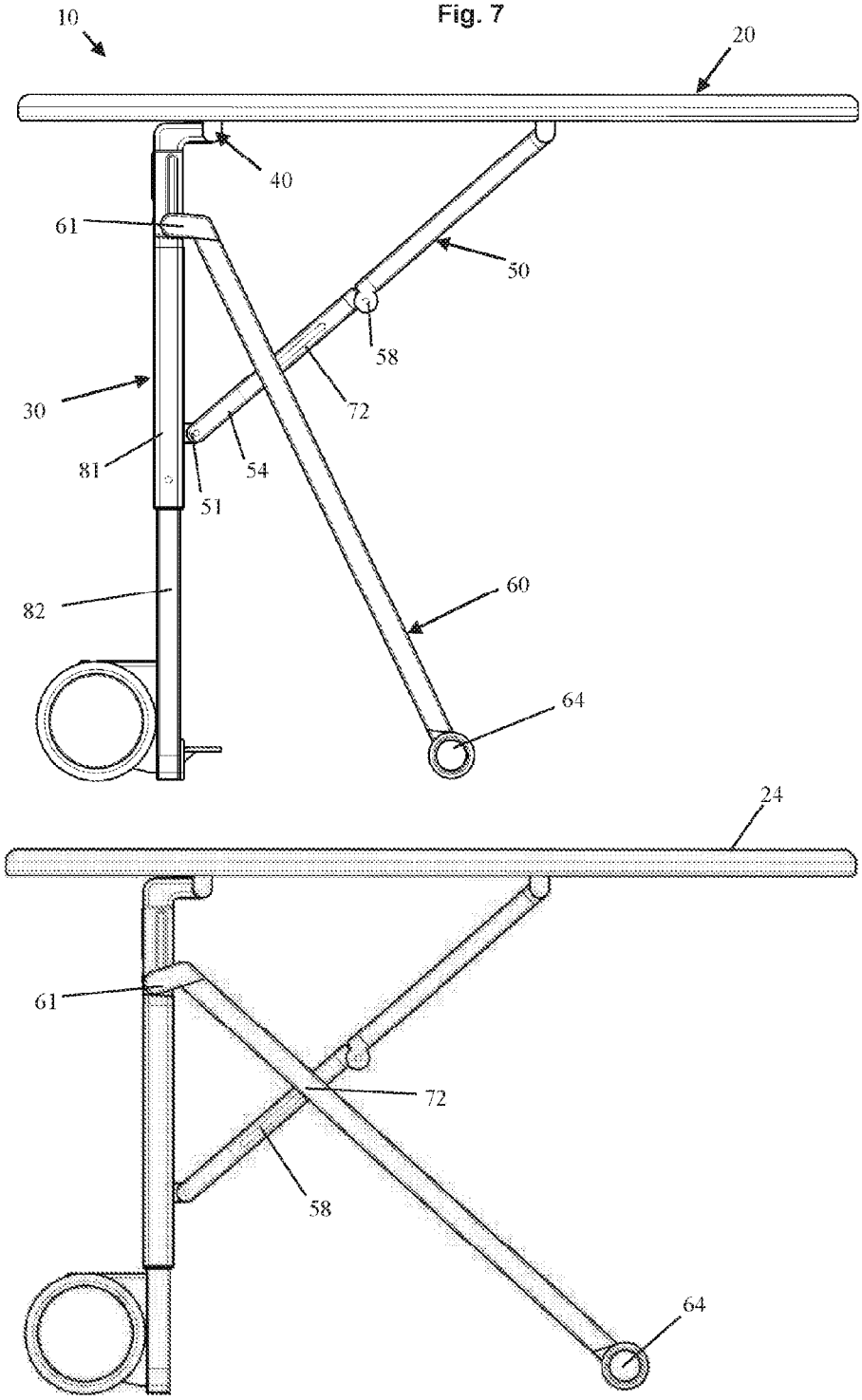
FIG. 7 shows a side view of an ironing board according to an exemplary embodiment having a collapsible support structure and a height adjustment mechanism in an ironing orientation and deployed at a first height and a second height.

The height adjustment mechanism 80 may be used with one or both of the support strut 50 and stabilising leg 60 of other exemplary embodiments. However, as shown in FIG. 7, suitably the height adjustment mechanism is used with the collapsible linkage 70 as described above comprising both the support strut 50 and the stabilising leg 60. As shown, both the pivot between the support strut 50 and the upwardly extending support 30 at anchor 51 and the pivot 61 between the stabilising leg and upwardly extending support 30 are arranged on the main section 81 of the telescopic upwardly extending support 30 as described above. Thus, the board 20 remains locked relative to the telescopic upwardly extending support 30 when the height adjustment mechanism 80 is operated. By being held on the main section, as the height adjustment mechanism is operated to lower the ironing surface 24, the height between the pivot connection 61 of the stabilising leg and the ground is also lowered. Suitably, as shown in FIG. 7, the stabilising leg 60 is adapted to accommodate the change in height so that the distal end 64 remains in a common plane, for instance, remains in contact with the ground without tilting the ironing surface 24. In the exemplary embodiment, the stabilising leg is adapted to be able to rotate further from the upwardly extending support 30. Here, the pivot 72 connecting the stabilising leg to the support strut is arranged to slide relative to one of the parts. As shown, suitably the pivot 72 slides relative to the support strut. Conveniently, the support strut 50, and in particular the first link 54, includes a track 58 along which the axis of the pivot connection 72 can slide. This sliding, coupled with rotation about pivot 61 allows the stabilising leg to further extend away from the telescopic upwardly extending support 30 as the adjustment mechanism lowers the board 20.

Figure 8:
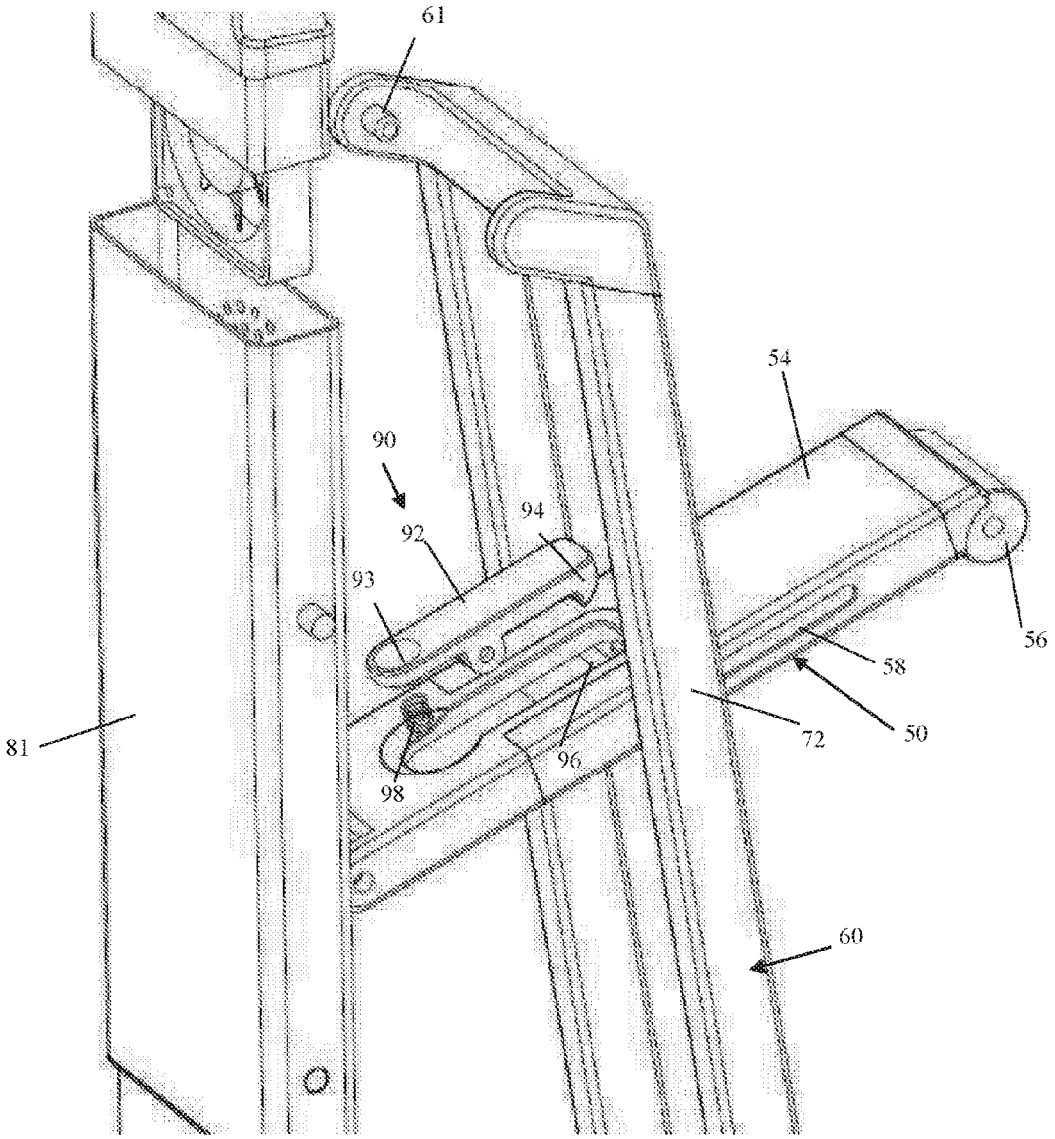
FIG. 8 shows an exploded perspective view of a portion of an exemplary ironing board including a locking mechanism.

It will be appreciated that the pivot connection 72 should be locked, so as not to slide when the ironing board is in use. Otherwise, downward force on the board could cause the pivot connection 72 to slide, extending the stabilising leg outwards and allowing the ironing board to tip. FIG. 8 shows a suitable latch 90 according to an exemplary embodiment to selectively lock the stabilising leg 60 relative to the telescopic upwardly extending support 30 and used in conjunction with the height adjustment mechanism 80. The latch 90 has a latch member 92 that is arranged to engage a catch member 96 to prevent relative movement between the support strut 50, and in particular the first link 54, and the stabilising leg 60. Here, the relative movement prevented is in the direction allowing the stabilising leg to rotate further away from the upwardly extending support. The latch member 92 can be released from the catch member 96 to enable relative movement. The latch member 92 may be engaged and disengaged from the catch by rotating the latch member 92. Here, the latch member 92 is pivotally connected to one of the parts and the catch member 96 formed on the other of the parts. For instance, with a rotation axis of the latch member 92 located at a mid-point of the latch member 92, depressing one end 93 causes the other end to lift away from the catch member 96. Suitably, the other end is shown as a hook 94 which hooks the catch member 96 to thereby engage the catch member 96. A biasing means such as a spring 98 may be arranged to bias the latch member towards engagement. In the exemplary embodiment shown in FIG. 8, the latch member 96 is connected to the support strut 50 and the catch member formed on the stabilising leg 60.

In operation, the latch 90 retains the pivot connection 72 in a fixed location relative to both the support strut 50 and stabilising leg 60 during manipulation between the stowed and ironing orientations and as herein described. When the height adjustment mechanism is operated, the latch 90 is released so that the pivot connection 72 slides, allowing the stabilising leg to re-orientate to accommodate the change in height. In the lowest position of the height adjustment mechanism, the stabilising leg is arranged in the fully extended orientation and, suitably, further relative movement of the pivot connection between the support strut 50 and stabilising leg 60 is prevented. Here, the movement may be restricted by the pivot connection abutting the end of the track 58. As the stabilising leg is rotated about pivot 61 back towards the upwardly extending support, the latch member 92 can be lifted clear of the catch member 96 or the latch 92, and in particular, the hook 94 may be shaped to ride over the catch member.

Suitably, the latch 90 prevents movement of the pivot connection 72 relative to the support strut 50 and stabilising leg 60 in a mid-position before the stabilising leg is fully extended. Here the catch member comprises a plurality of catches, for instance a rack of catches. The plurality of catches can correspond to multiple height positions of the height adjustment mechanism 80.

Figure 9:
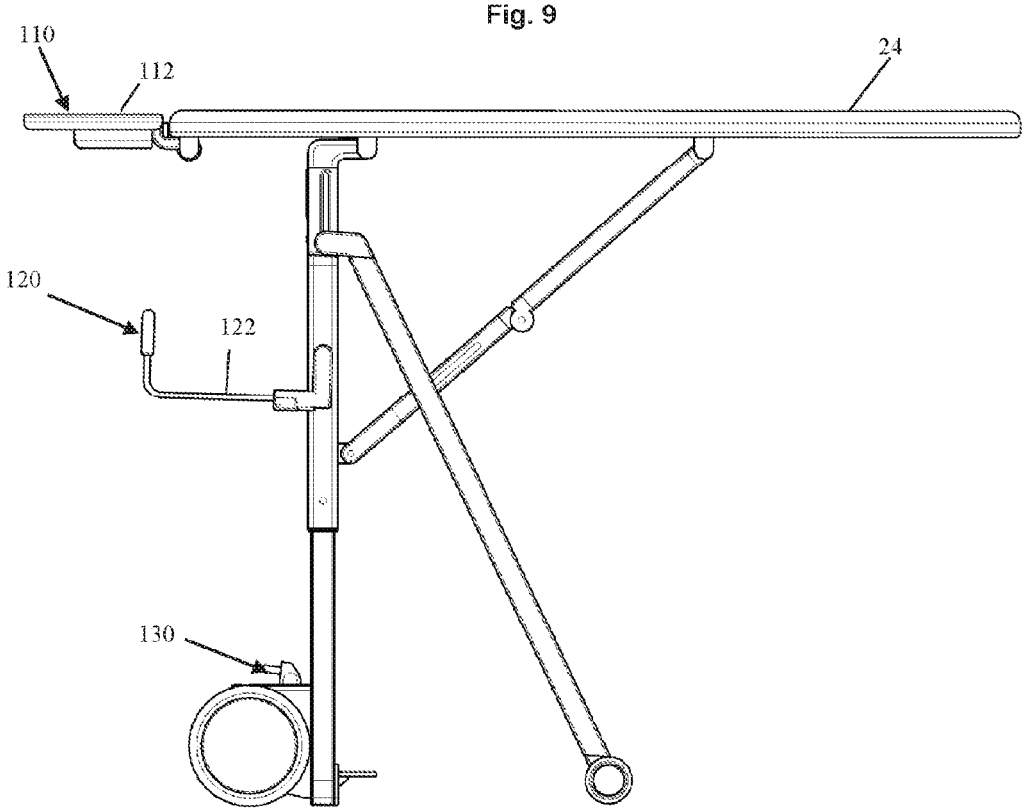
FIG. 9 shows a side view of an ironing board according to an exemplary embodiment including optional attachments in an ironing orientation.

Referring to FIG. 9 an exemplary ironing board embodiment is shown. The ironing board 10 includes a board 20, upwardly extending support 30, pivot 40, collapsible support 70 including both a support strut 50 and stabilising leg 60, a height adjustment mechanism 80 and corresponding latch 90 each as herein described. In addition, FIG. 9 shows optional additions to the ironing board 10 that can each be adopted on the exemplary embodiments independently, in isolation or in conjunction with one or more other additions.

One optional addition is a dock 110. The dock provides a working platform 112 to rest an iron when ironing. Suitably, the dock 110 is connected to the board 20 as an extension to the ironing face 24. The dock 110 is shown as being connected to the board to be able to pivot from a stowed arrangement, wherein the working platform is folded against the board, and suitably against the underside 22 of the board (see for instance FIG. 15), to an ironing arrangement, with the working platform extending from the broad end 26 of the board 20. A retainer (not shown) is used to hold the working platform in the ironing arrangement.

Figure 12:
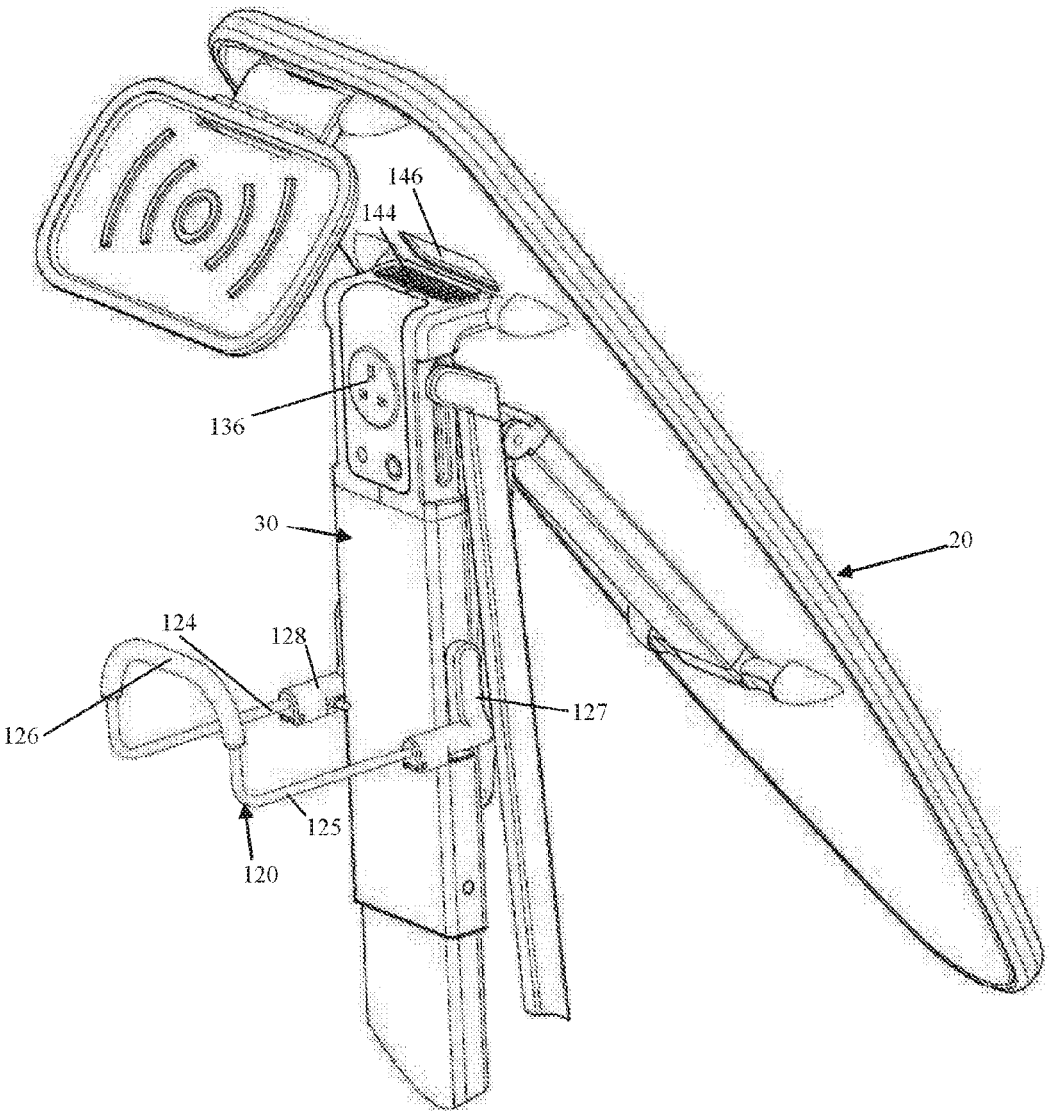
FIG. 12 shows of a further perspective view of an exemplary ironing board including an air-movement system.

Another optional addition is a storage arm 120. The storage arm 120 provides a storage platform 122 for an iron, for instance when the ironing board 10 is in the stowed orientation. Here, the iron might include a steam generation unit that remains on the storage platform in use. The storage platform 122 may be shaped to support the iron and is suitably pivotally connected to the upwardly extending support so that it can be folded out of the way when not in use. For instance, the storage platform 122 can be rotated downwardly to be stowed compactly against the upwardly extending support 30 (see for instance FIG. 15). To accommodate different sizes of iron, the support may be extendible. For instance, as shown in FIG. 12 for instance, the support platform 122 may comprise left and right support arms 124, 125 that are connected by an end stop 126. The left and right support arms terminate in connectors 127, 128 that form the connection, and in the foldable example shown, the pivotal connection to the upwardly extending support 30. To be extendible, the support arms move in and out of apertures in the connectors 127, 128. A pin (not shown) or the like may be provided to hold the arms in the desired extension from the connectors. Thus the support platform 122 is able to accommodate different irons. Moreover, as shown in the exemplary embodiments, the storage arm 120 is connected to the upwardly extending support 30 spaced from the fixed pivot 40. This spacing allows the storage platform 122 to be arranged beneath the board 20 which lowers the center of gravity and provides improved stability as opposed to an arrangement wherein the iron, and in particular a steam generation unit of an iron, is stored on a level with the board.

Another optional addition is a power cable arrangement 130. The power cable arrangement 130 is better shown in FIG. 10. Here, the power cable arrangement includes a power cable 132 for supplying power to the ironing board and a spool 134. The power cable 132 may be wound on the spool for storage. In use, the power cable 132 can be unwound from the spool 134 to connect a connector 133 on an end of the power cable to a socket (not shown). The other end of the power cable 132 is connected to an electrical iron, for instance via a plug 136 (see FIG. 12). By providing a power cable arrangement 130, the power cable can be extended substantially along the ground without dangling mid-air. Suitably, the spool 134 is arranged in the lower end 34 of the upwardly extending support 30. Thus the power cable 132 can be unwound close to the ground and, as mentioned previously, the bulbous lower end 34 provides a convenient location space as well as the additional parts adding ballast. The spool 134 may be moveable, and preferably rotatable. The spool 134 may also be biased to automatically wind the power cable 132. Here the spool can be released to wind the power cable 132 by operating lever 136.

Figure 11:
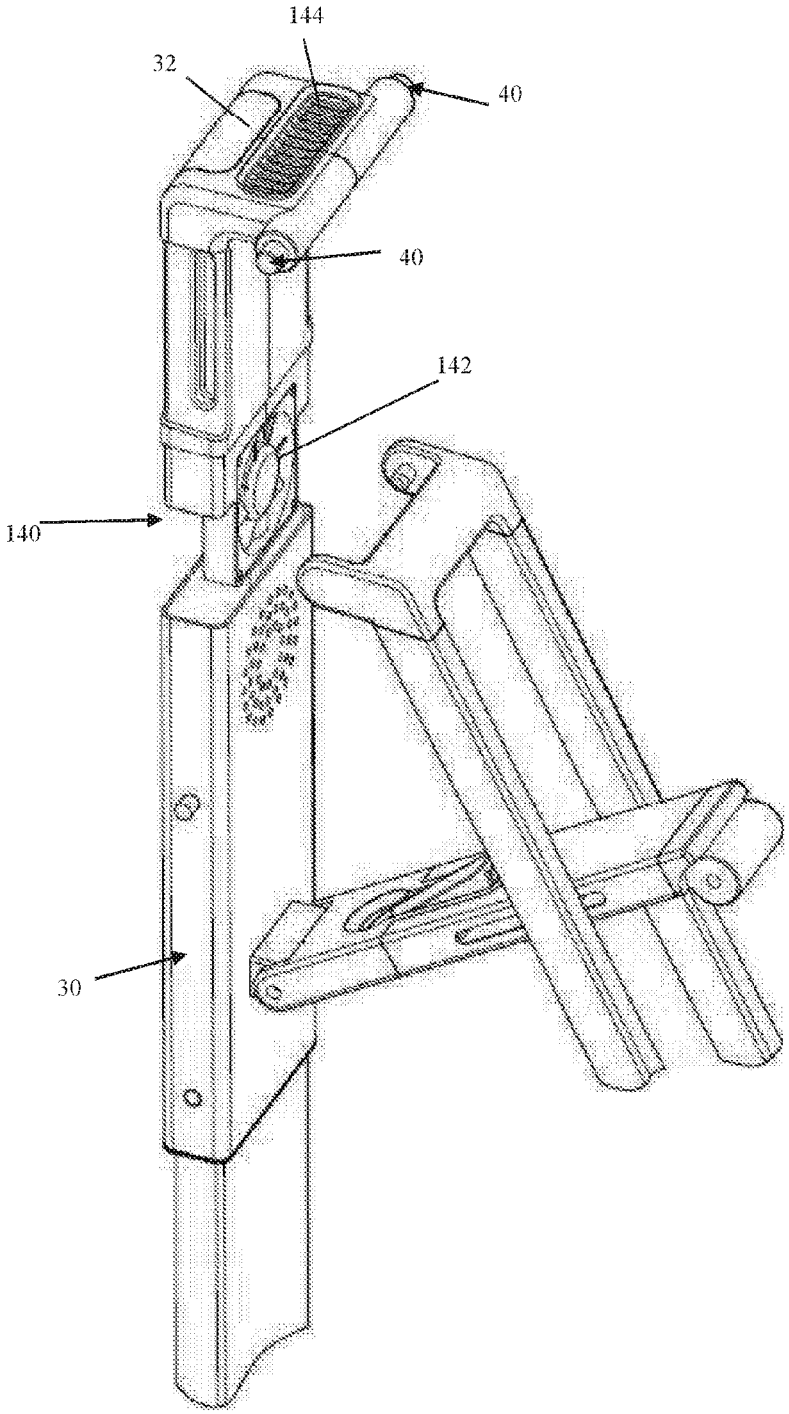
FIG. 11 shows an exploded view of a portion of an exemplary ironing board including an air-movement system.

Another optional addition is an air movement system 140. As shown in FIG. 11, the air movement system 140 includes an air-movement device 142 mounted in the upwardly extending support 30. The air-movement device 142 is suitably a fan for blowing air. The air movement device 142 cooperates with a channel (not shown) in the upwardly extending support 30 and creates an air pressure differential in the channel to either suck air towards the fan or push air away from the fan within the channel 142. Here, the channel includes an aperture 144 formed in the abutment surface 32 of the upwardly extending support 30. The air movement system 140 includes a cavity (not shown) within the board 20, wherein said cavity is in communication with the ironing surface 24 via apertures so that air can be sucked or blown through the apertures to assist the ironing process. Here, the board 20 is correspondingly adapted to include an aperture 146 (see FIG. 12). As follows from the foregoing, as the board is manipulated from the stowed orientation to the ironing orientation, the apertures 144, 146 are arranged to be aligned to provide a continuous air passage between the cavity in the board 20 and the channel in the upwardly extending support 30. A seal may be provided to assist the forming of the continuous air passage. Advantageously, because the aperture 144, 146 are mated by relative rotation, without respective sliding or linear motion of the apertures, the apertures can be mated, and where necessary sealed in a more repeatable movement.

Figure 21:
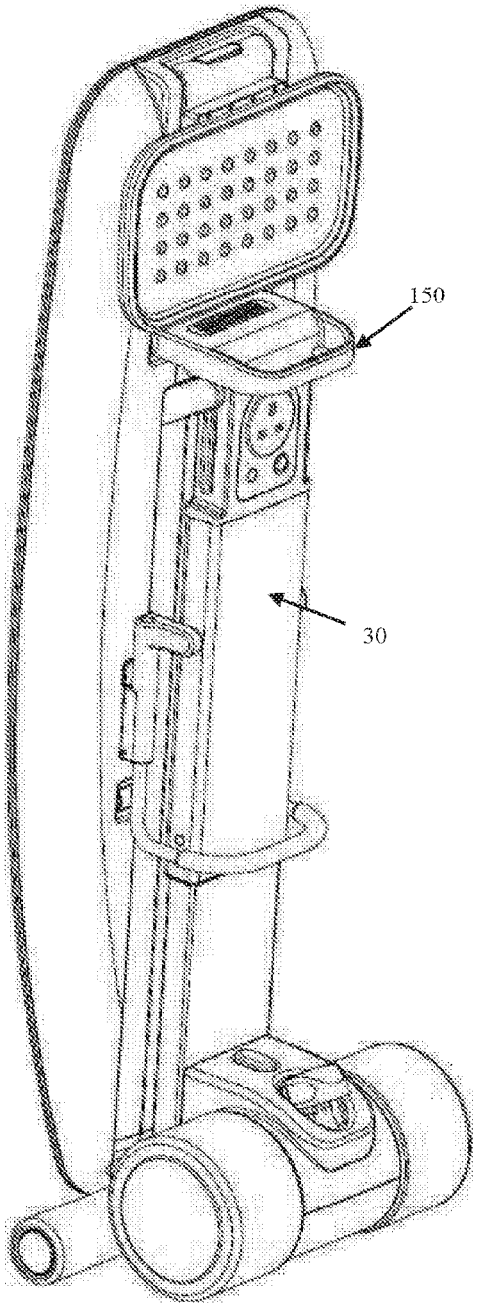
FIG. 21 shows a perspective view of the exemplary ironing board in a stowed orientation.

Referring to FIG. 21, a further optional addition comprises a handle 150. Here the handle 150 is formed to extend from the upper end of the upwardly extending support 30. The handle provides a convenient gripping location for a user to grip the ironing board when maneuvering the ironing board in the stowed orientation. Suitably, the handle 150 is shown as a u-shaped band 152 extending and secured to either side of the upwardly extending support 30 and providing a convenient gripping location via a spacing between the band 152 and upwardly extending support.

Figure 13:
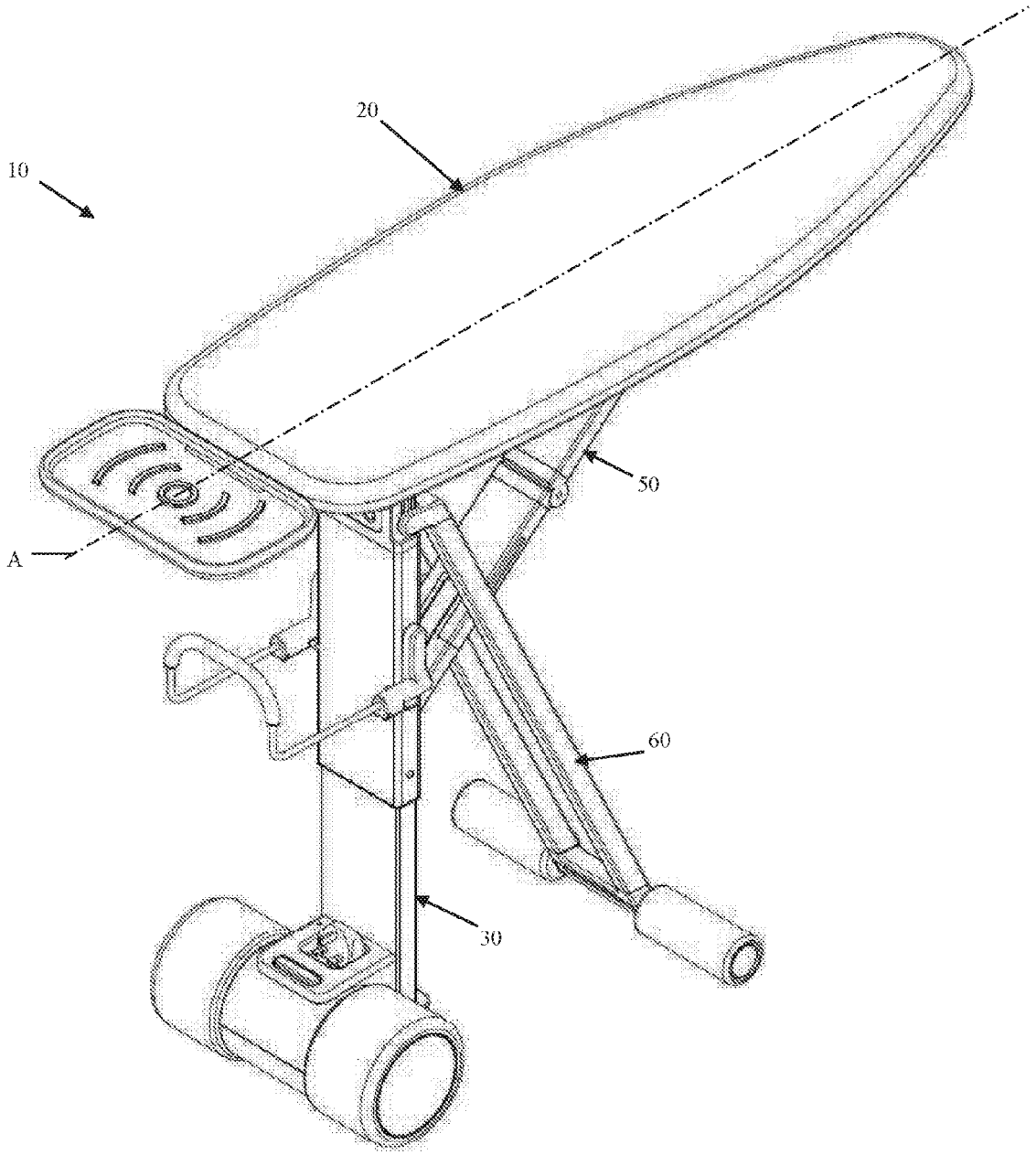
FIGS. 13 and 14 show top and bottom perspective views respectively of an exemplary ironing board in an ironing orientation.
Figure 14:
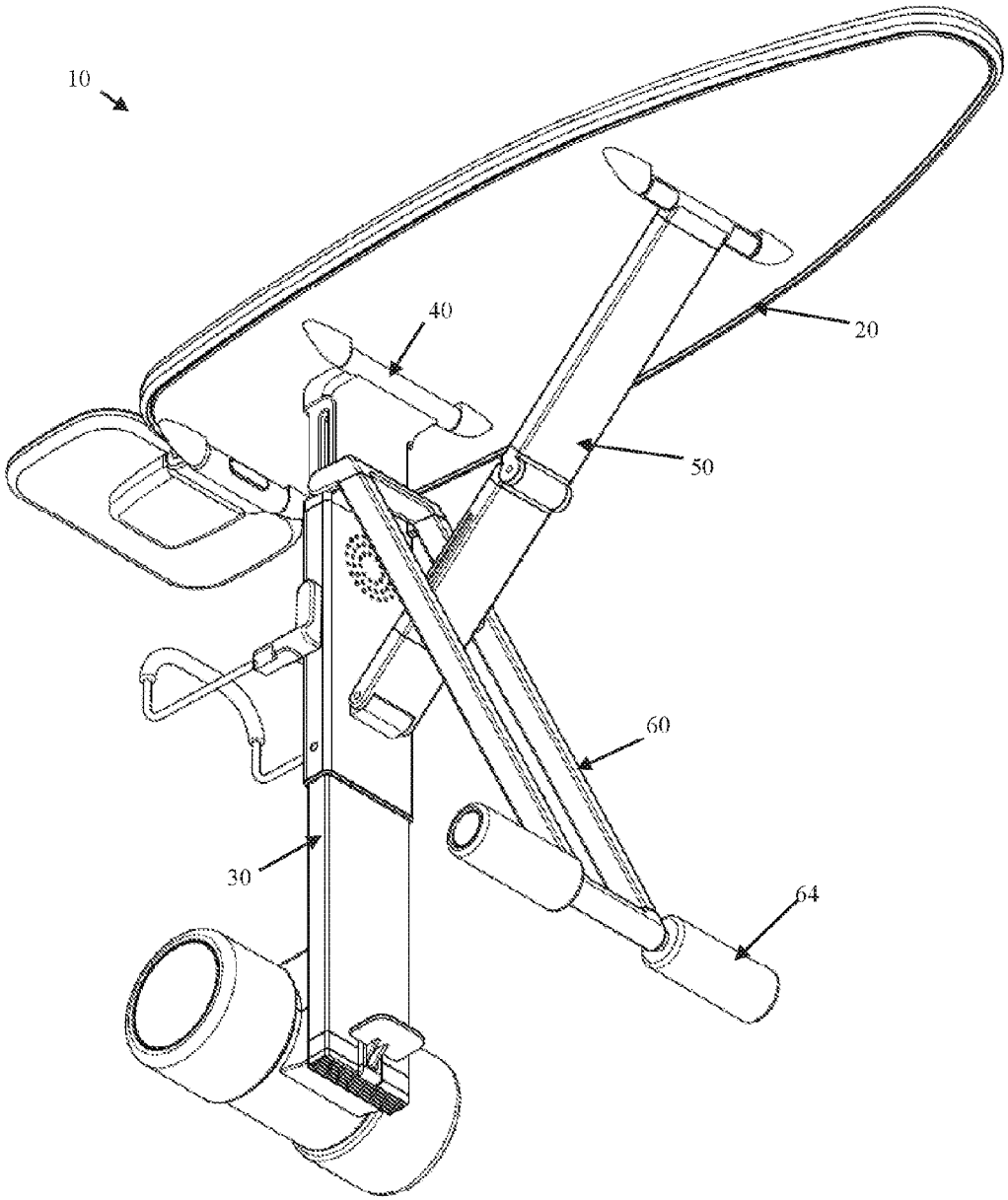
Figure 15:
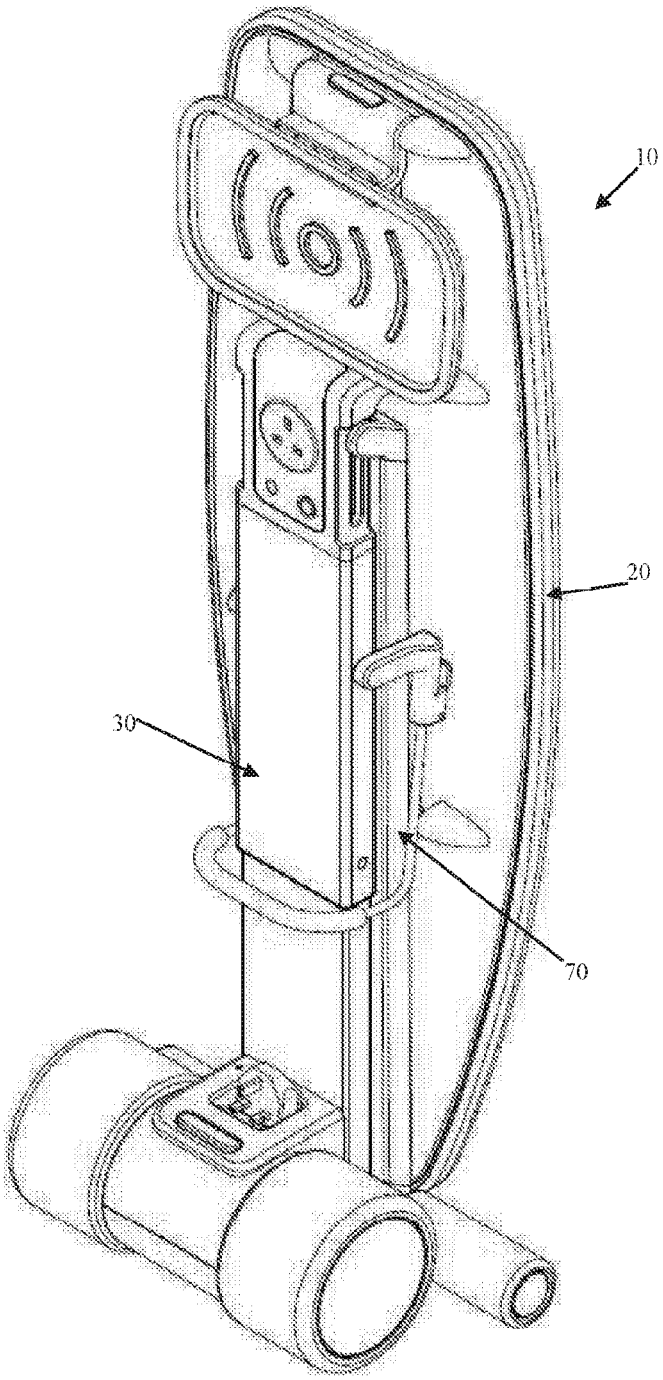
FIG. 15 shows a perspective view of the exemplary ironing board of FIGS. 13 and 14 shown in a stowed orientation.

FIGS. 13 and 14 show an exemplary ironing board 10 as herein described in an ironing orientation. As mentioned, the ironing board is substantially symmetrical about a vertical plane through the longitudinal axis A. Here, each connection, and in particular, each pivot connection comprises a first part spaced to one side of longitudinal axis and a corresponding, substantially identical second part spaced to the other side of the longitudinal axis A. Thus, widthwise stability to the rotations and connections is provided. As shown in FIG. 13, the upwardly extending support is provided with the main extent having a substantially rectangular box like construction. The lower end 34 of the upwardly extending support 30 may also be bulbous in the width direction. The stabilising leg includes a left elongate member and a right elongate member extending from the connection end. Thus, the support strut, which is conveniently also shown as having a rectangular box like construction is arranged in-between the left and right elongate arms. By providing the upwardly extending support 30 and support strut 50 in a rectangular box like construction, the ironing board provides improved resistance to skew, and in particular across the respective pivot axes. The distal end 64 of the stabilising leg 60 is shown as being flared with left and right rollers to assist the distal end 64 extending across a ground surface. FIG. 15 shows the ironing board arranged in a stowed orientation.

Figure 16:
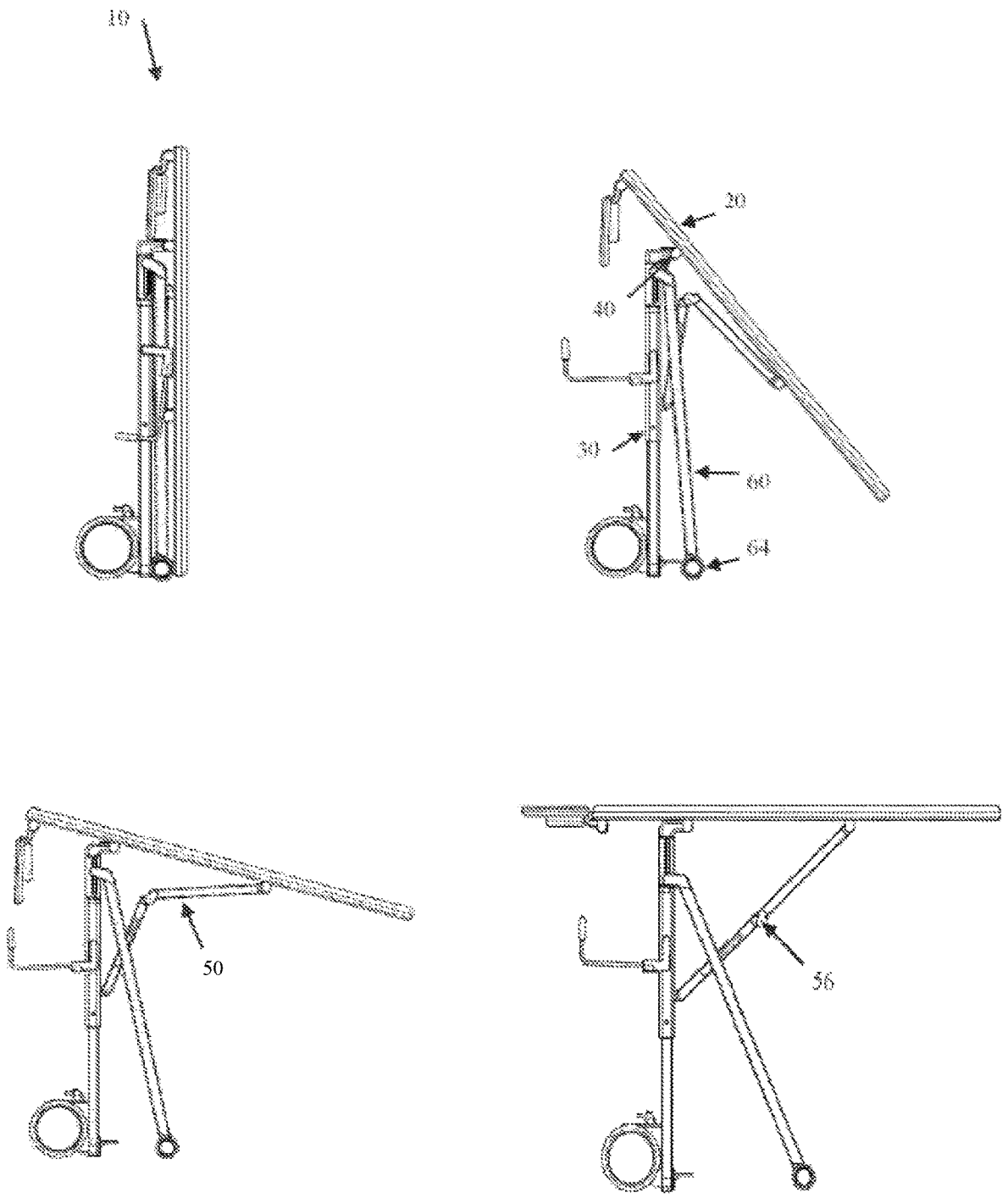
FIG. 16 shows sequential side views of the exemplary ironing board of FIGS. 13-15 being manipulated between stowed and ironing orientations.
Figure 17:
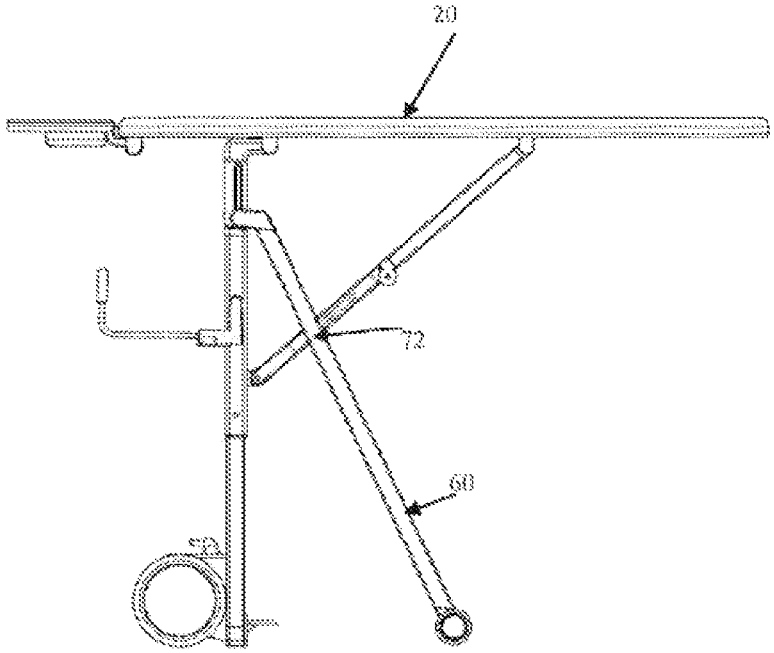
FIG. 17 shows side views of the exemplary ironing board of FIGS. 12-16 in an ironing orientation and at first and second heights.
Figure 17:
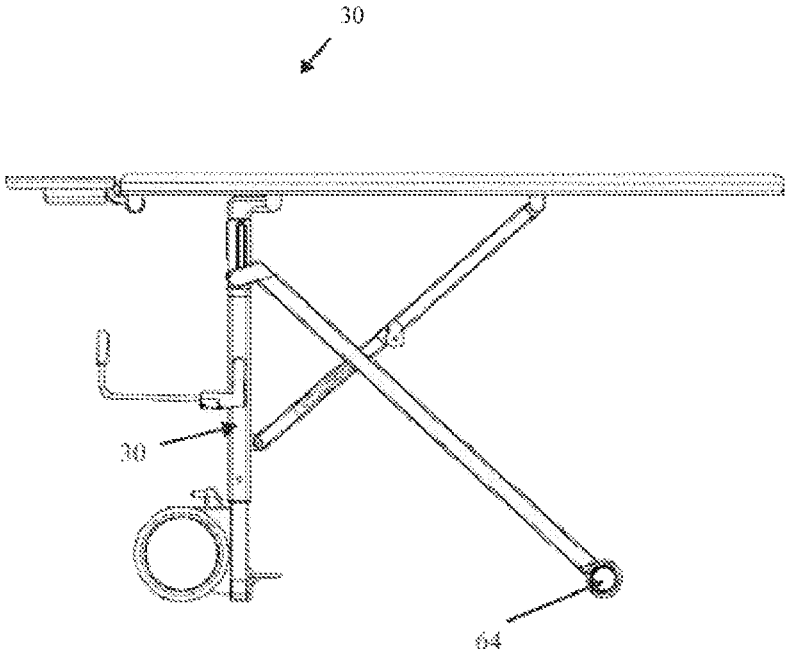

Referring to FIGS. 16 and 17, a manipulation process is shown wherein the exemplary ironing board 10 is manipulated from a stowed orientation to an ironing orientation, and then from a first height to a second height. From the stowed orientation, the ironing board 10 is self-supported in an upright arrangement wherein the pivot 40 is spaced at a first height from the ground. Here the pivot 40 is supported by the upwardly extending support 30. Initially or at another time, the optional storage arm 120 is rotated to position. The manipulation process to the ironing orientation begins by opening the collapsible support 70. Typically this will be performed by a user grasping towards the nose end 28 of the board and rotating the board about pivot 40. Advantageously, because pivot 40 is supported, the user does not need to support the pivot 40. Rather, the user can focus the manipulation of rotating the board 20 about the pivot. As the board 20 rotates, the collapsible support 70 is opened. As described, the opening of the collapsible support, driven by rotation of the board, causes the stabilising leg 60 to open and importantly, causes the distal end 62 to move along the plane of the ground and away from the upwardly extending support 30. This increases the footprint in the thickness direction and provides stability to the ironing board 10, and in particular the upwardly extending support 30 from toppling.

Opening of the collapsible support 70 also causes the support strut 50 to open. Continued rotation of the board 20 about the pivot 40 causes the support strut to become fully opened, wherein the elbow 56 is arranged in an over-center arrangement. Here, the elbow 56 acts to lock the board relative to the upwardly extending support 30 by preventing reverse rotation of the board back towards the stowed orientation. It will be appreciated the board 20 has now reached the ironing orientation and the optional apertures 144, 146 of the air movement system 140 by abutment of the board and abutment face. At some convenient time in the process, the optional dock 110 can be deployed.

Referring to FIG. 17, with the board locked in orientation about the pivot 40, the height activation mechanism 80 can be operated. Here, releasing the telescoping upwardly extending support 30 and releasing the latch 90 to release the pivot connection 72 to slide, the ironing surface 24 can be lowered by pushing down on the board. The ironing surface moves in a substantially parallel orientation.

Figure 18:
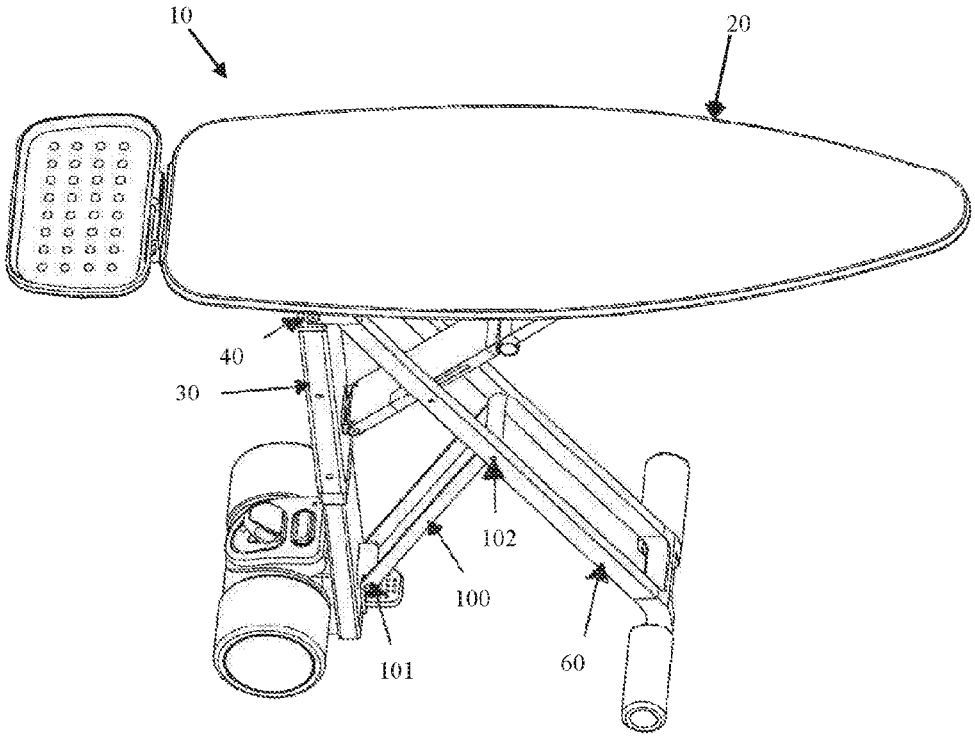
FIGS. 18 and 19 show top perspective views of an exemplary ironing board in an ironing orientation and at first and second heights respectively.
Figure 19:
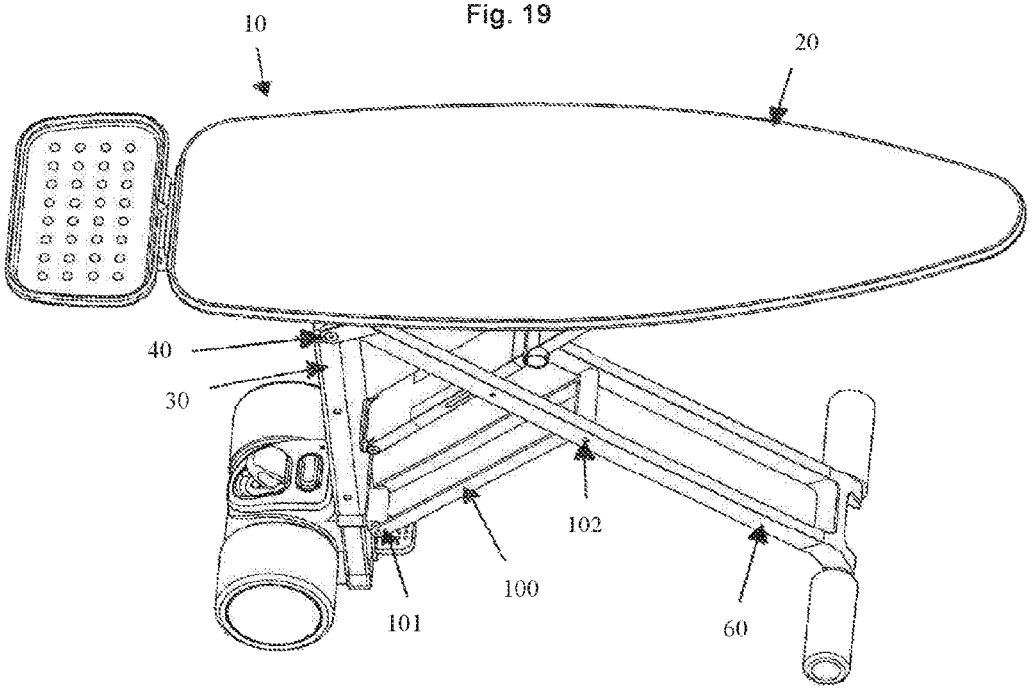

FIGS. 18 and 19 show perspective views of an exemplary ironing board 10 in an ironing orientation. The ironing board 10 is shown in first and second height positions respectively. As shown in both figures, a second support strut 100 extends between the upwardly extending support 30 and the stabilising leg 60. The second support strut 100 comprises a first end 101 pivotally attached to a lower portion of the upwardly extending support 30 and a second end 102 pivotally attached to the centre of the stabilising leg 60. In this configuration, as the height of the pivot 40 is adjusted by raising or lowering the telescopic upwardly extending support 30, the second support strut 100 simultaneously adjusts the position of the stabilising leg 60 in relation to the upwardly extending support 30. Therefore, the board 20 is maintained in a horizontal position whilst the height of the pivot 40 is adjusted.

Figure 20:
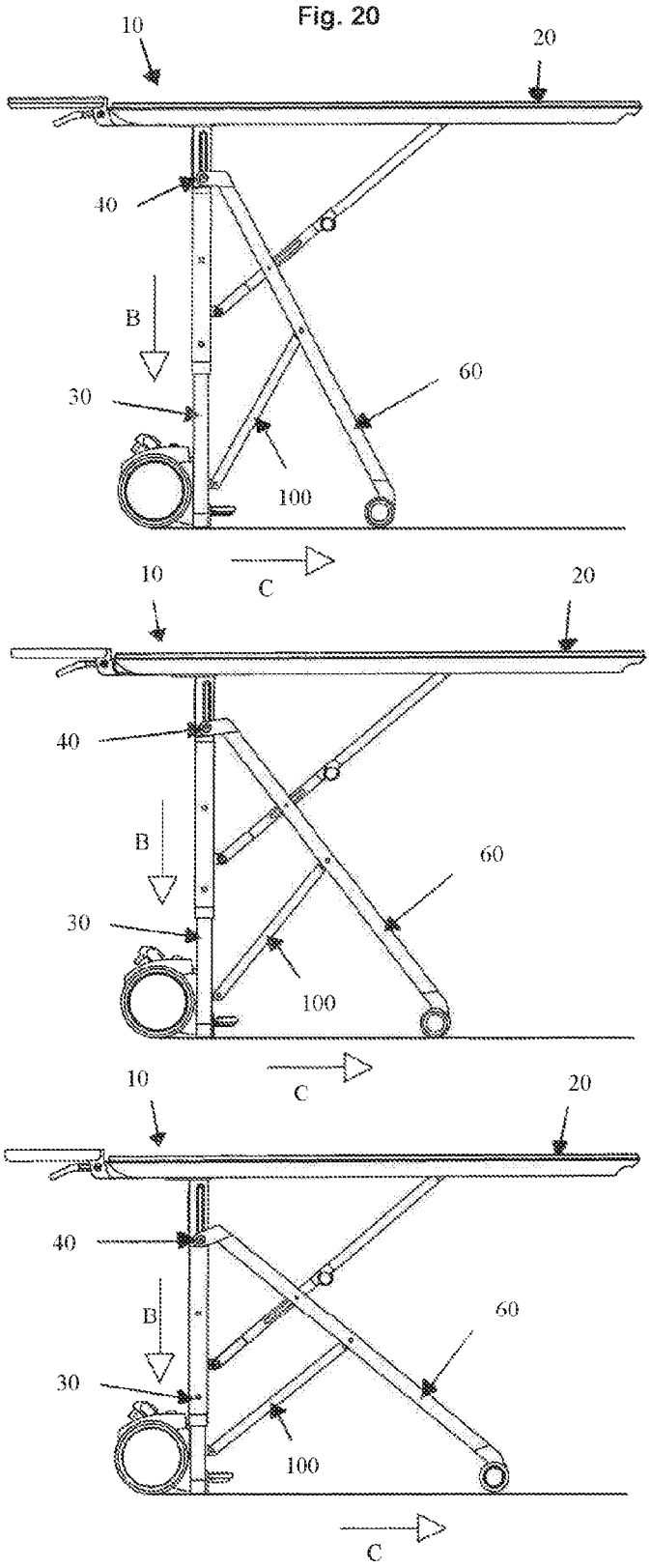
FIG. 20 shows sequential side views of the exemplary ironing board of FIGS. 18 and 19 being manipulated between various height positions.

Referring to FIG. 20, a manipulation process is shown wherein the exemplary ironing board 10 is manipulated from a first height position, to a second height position to a third height position. As the height of the pivot 40 is reduced by lowering the upwardly extending support 30 in the direction of arrow 'B', the stabilising leg 60 simultaneously moves in the direction of arrow 'C' due to the rigidity of the second support strut 100. The second support strut 100 is pivotally attached to the upwardly extending support 30 and the stabilising leg 60 and is configured to adjust the position of the stabilising leg 60 in relation to the upwardly extending support 30 when the height of the pivot 40 is adjusted. It can be seen that as the height of the pivot 40 is reduced further, by lowering the upwardly extending support 30 in the direction of arrow 'B', the position of the stabilising leg 60 is shifted further from the upwardly extending support 30 in the direction of arrow 'C'. Therefore, the board 20 is maintained horizontally as the height of the pivot 40 is adjusted, by extending or lowering the upwardly extending support 30, due to the second support strut 100 automatically adjusting the position of the stabilising leg in relation to the upwardly extending support 30. This is advantageous as this feature allows the ironing board 10 to be operated at any height position.

The ironing board is manipulated back to the stowed orientation through a reverse operation. The latch 90 and height adjustment mechanism 80 are released and the board 20 raised by applying an upward force. It will be appreciated that as described above, in the lowest position the latch is not engaged and is therefore already released. Once fully raised, the latch becomes caught preventing sliding of the pivot connection 72. Now the elbow can be broken by urging the elbow's pivot axis back past the straight line joining the anchors 51, 52. At this point, the board 20 can be rotated about the pivot towards the stowed orientation, which automatically collapses the collapsible support 70.

Because the pivot 40 is supported by the upwardly extending support 30 at each stage of the manipulation process, the user can manipulate the ironing board between stowed and ironing positions with a rotating movement only. That is, the user does not have to change grips or a movement action, thereby simplifying the manipulation and providing an improved, more user friendly manipulation process.

Although preferred embodiments have been shown and described, it will be appreciated by those skilled in the art that changes may be made without departing from the scope of the claims as defined in the claims.

The invention claimed is:

1. An ironing board comprising:

a board;

an upwardly extending support;

a pivot that pivotally connects the board and upwardly extending support, the pivot being arranged so that the board is rotatable about the pivot and relative to the upwardly extending support between a stowed orientation, in which the ironing board is self-supporting, and an ironing orientation, wherein the pivot is fixed relative to both the board and the upwardly extending support; and a collapsible support arranged to support the ironing board in the ironing orientation and to be collapsible when the ironing board is manipulated from the ironing orientation to the stowed orientation, wherein the collapsible support including a stabilising leg to support the board in its ironing orientation, and wherein the stabilising leg is pivotally connected to the upwardly extending support by a second pivot, the second pivot being slideable to enable relative sliding movement between the upwardly extending support and the stabilising leg.

2. An ironing board of claim 1, wherein the ironing board is self-supporting such that it remains supported in an upright position on a level surface when the board is in the stowed orientation, without external, or additional, support.

3. The ironing board of claim 1, wherein the collapsible support includes a support strut to support the board and to resist rotation of the board about the pivot from the ironing orientation to the stowed orientation.

4. The ironing board of claim 3, wherein the support strut is pivotally connected to the board and the upwardly extending support, the support strut being lockable when the board is in the ironing orientation so as to brace the board to the upwardly extending support.

5. The ironing board of claim 4, wherein the support strut comprises a first strut part and a second strut part that are connected by an elbow, wherein the first strut part is pivotally connected to an anchor on the upwardly extending support and the second strut part is pivotally connected to an anchor on the board to provide said pivotal connections.

6. The ironing board of claim 5, wherein the elbow provides an over-centre lock to prevent collapsing of the collapsible support.

7. The ironing board of claim 3, wherein the support strut and the stabilising leg are pivotally connected together by a pivot connection.

8. The ironing board of claim 3, wherein the collapsible support includes a second support strut that extends between the upwardly extending support and the stabilising leg.

9. The ironing board of claim 1, further comprising a height adjustment mechanism that is operable to raise and lower a height of the pivot, wherein the upwardly extending support is telescopic.

10. The ironing board of claim 7, wherein the pivot connection is arranged to be able to slide to enable relative sliding movement between the support strut and the stabilising leg, and the ironing board includes a latch to releasably secure the pivot connection to be fixed relative to the support strut and the stabilising leg.

11. The ironing board of claim 10, wherein the second support strut is pivotally connected to a lower region of the upwardly extending support and the stabilising leg; and is configured to adjust the position of the stabilising leg relative to the upwardly extending support when the height of the pivot is adjusted by a height adjustment mechanism that is operable to raise and lower a height of the pivot.

12. The ironing board of any of claim 1, further comprising a power cable arrangement comprising a plug provided on the upwardly extending support, a power cable electrically connected to the plug, and a spool for winding the power cable.

13. The ironing board of any of claim 1, further comprising an air movement system comprising an air movement device housed in the upwardly extending support, a channel provided between the air movement device and an aperture in the upwardly extending support, a cavity provided in the board and provided between apertures in an ironing face of the board and an aperture on an underside of the board, wherein the apertures are arranged to mate when the board is rotated to the ironing orientation.

14. The ironing board of claim 1, further comprising a footprint defined by at least one point of contact between the ironing board and the level surface, wherein the ironing board is self-supporting when a centre of gravity of the ironing board is positioned within said footprint.

15. The ironing board of claim 14, wherein the at least one point of contact includes the upwardly extending support.

16. The ironing board of claim 1, further comprising a footprint defined by at least one point of contact between the ironing board and the level surface, wherein the ironing board is self-supporting when a centre of gravity of the ironing board is positioned within said footprint, wherein the at least one point of contact includes the upwardly extending support, and wherein the at least one point of contact also includes the stabilising leg.

17. The ironing board of claim 15, wherein the at least one point of contact also includes a nose of the board.

* * * * *